US005663514A

United States Patent [19]

Usa

[11] Patent Number: 5,663,514

[45] Date of Patent: Sep. 2, 1997

[54] APPARATUS AND METHOD FOR CONTROLLING PERFORMANCE DYNAMICS AND TEMPO IN RESPONSE TO PLAYER'S GESTURE

[75] Inventor: Satoshi Usa, Hamamatsu, Japan

[73] Assignee: Yamaha Corporation, Japan

[21] Appl. No.: 643,121

[22] Filed: Apr. 30, 1996

[30] Foreign Application Priority Data

May 2, 1995 [JP] Japan ..... 7-132915
Jun. 12, 1995 [JP] Japan ..... 7-169174

[51] Int. Cl.[6] ..... G10H 1/057; G10H 1/40

[52] U.S. Cl. ..... 84/600; 84/658; 84/662; 84/668; 84/DIG. 12

[58] Field of Search ..... 84/600, 612, 636, 84/652–658, 662, 687–690, 668, 615–620, 626, DIG. 12, 453

[56] References Cited

U.S. PATENT DOCUMENTS 4,341,140 7/1982 Ishida .
4,829,872 5/1989 Topic et al. ..... 84/453
5,177,311 1/1993 Suzuki et al. ..... 84/687 X
5,288,938 2/1994 Wheaton ..... 84/658 X

*Primary Examiner*—Stanley J. Witkowski
*Attorney, Agent, or Firm*—Graham & James LLP

[57] ABSTRACT

A specific type of a human operator's gesture (such as a downward, upward or lateral swinging movement) and its movement amount (such as a speed or acceleration of the movement) is detected by a movement detector. The detected movement amount is compensated in accordance with the detected movement type, and various factors to control dynamics of a music performance (such as tone volume, color, pitch, effect etc.) are variably controlled on the basis of the compensated movement amount. At least one of minimal and maximal values indicative of the operator's repetitive gesture is selectively extracted from the output of the movement detector so that the performance tempo is controlled on the basis of a particular time point at which the selected minimal or maximal value has been extracted. Extreme value (minimal or maximal value) indicative of the operator's repetitive gesture is extracted from the output of the movement detector and a tempo controlling point is set a predetermined time after a particular time point at which the extreme value has been extracted, so that the performance tempo is controlled on the basis of the thus-set tempo controlling point.

24 Claims, 18 Drawing Sheets

APPARATUS AND METHOD FOR CONTROLLING PERFORMANCE DYNAMICS AND TEMPO IN RESPONSE TO PLAYER'S GESTURE

BACKGROUND OF THE INVENTION

The present invention relates to an apparatus and method for controlling performance dynamics in an electronic musical instrument or the like in response to player's gestures.

The present invention also relates to an apparatus and method for controlling a performance tempo in an automatic performance device in response to player's motions.

Automatic performance devices have been conventionally known which prestore in memory performance information on individual notes (note data) for melody and accompaniment performances, and automatically read out the prestored performance information at a given tempo to generate melody and accompaniment tones in accordance with the performance information. In such known automatic performance devices, the performance tempo is determined by a frequency of tempo clock pulses generated from a timer or the like, and the tempo clock frequency can be freely varied via a tempo setting switch or the like.

However, where the tempo is varied during a performance by operating the tempo setting switch or the like, it is very difficult to achieve fine tempo variations like those responsive to a player's gesture such as the player's handling or swinging of a baton, because the tempo variation depends solely on how the switch is operated (e.g., operated amount and velocity of the switch).

To provide a solution to the problem, an automatic performance device has recently been proposed, such as in U.S. Pat. No. 4,341,140, which is characterized by an accelerometer provided within a baton (conducting stick) that is handled or swung by the hand of a player or human operator. The device detects a maximal value of output signals from the accelerometer generated in response to the operator's swinging of the baton and controls a tempo and tone volume of an automatic performance at the time of the maximal value detection. By generating tone or advancing read address of sequence data at the time of the maximal value detection, the proposed automatic performance device can optionally control the performance tempo, and also control tone volume in accordance with the output values of the accelerometer so that performance dynamics (i.e., application of strength and weakness to sounds to give activeness to the entire performance) can be optionally controlled accordingly.

Namely, when the operator or conductor moves the baton strongly or rapidly, the accelerometer outputs a relatively great value and the performance dynamics are raised, so that the sound variation rate is increased to make the entire performance stronger; conversely, when the operator moves the baton weakly or slowly, the accelerometer outputs a smaller value and the performance dynamics are lowered, so that the sound variation rate is reduced to make the entire performance weaker.

In the automatic performance based on the conductor's actual swinging of the baton, the performance dynamics and tempo are controlled by various factors such as the conductor's beating, accelerating/decelerating and clicking actions and a shape of locus drawn by the tip of the baton linking the beating points. However, with the prior art automatic performance device where the performance dynamics are controlled in response to the operator's swinging of the baton, i.e., output signals from the accelerometer, strength, speed etc. of the operator's swinging motion undesirably tend to vary or become uneven depending on how skillful the operator is in conducting, feeling of the operator and contents (type or genre) of a music piece being performed. Such uneven strength, speed etc. would directly lead to unevenness in output values of the accelerometer, making it very difficult to execute a performance with dynamics as contemplated by the operator.

For example, if the operator swings the baton in a duple-time or quadruple-time vertical motion or a triple-time triangular-locus motion with no particular attention, the downward swinging movement (down-beat), in most cases, tends to be stronger and quicker than the upward swinging movement (up-beat) and lateral swinging movement of a second beat in a triple-time performance. Thus, even when the operator thinks that he or she is swinging at an uniform strength and speed, the output values of the accelerometer would undesirably vary in response to the unevenness in the swinging motion; that is, output values of the accelerometer caused by the downward swinging movement (down-beat) and hence the performance dynamics would become greater than those resulting from other swinging movements. This causes the performance dynamics to vary more or less in dependence on the operator's habit in making swinging motions.

Similarly, the performance tempo undesirably tends to vary or become uneven depending on how skillful the operator is in conducting, feeling of the operator and contents (type or genre) of a music piece being performed. Therefore, the performance tempo, i.e., timing to generate tone or advance read address of the sequence data, would differ from one operator to another. This presents a significant problem that a tempo as contemplated by the operator can not be obtained by merely generating tone or advancing read address of the sequence data at the time of detection of a maximal output value of the accelerometer.

SUMMARY OF THE INVENTION

It is therefore an object of the present invention to provide an apparatus and method for controlling performance dynamics which can eliminate unevenness of performance dynamics caused by a human operator's habit in gesturing or the like and thereby achieve performance dynamics as contemplated by the operator.

It is another object of the present invention to provide an apparatus and method for controlling a performance tempo which can optionally control a performance tempo by, in response to an operator's hand swinging motion, generating a tone or advancing read address of sequence data at a time point as contemplated by the operator.

In order to accomplish the above-mentioned objects, the present invention provides a performance dynamics controlling apparatus which comprises a movement detection section for detecting a movement type and movement amount of a human operator's gesture on the basis of the gesture, a compensation section for compensating the movement amount in accordance with the movement type detected by the movement detection section, and a control section for, on the basis of the movement amount compensated by the compensation section, controlling a predetermined factor to control dynamics of a performance.

In the performance dynamics controlling apparatus thus arranged, the movement detection section detects a movement type and movement amount of a human operator's gesture on the basis of the gesture, i.e., a conductor's body-swinging or hand-swinging motion. Here, movement types to be detected may correspond to directions of movement of a baton executed by the operator such as downward, upward and lateral movements, or may correspond to other predetermined forms of movement. The detected movement amount is compensated in accordance with the movement type detected by the movement detection section, and the performance dynamics are controlled on the basis of the compensated movement amount. By this compensation, the performance dynamics can be controlled properly while eliminating unevenness of the movement amounts caused by different movement types.

For example, the baton may contain, as the movement detection section, two angular speed sensors operable in two orthogonal dimensions. In such a case, in response to the human operator swinging the baton vertically or in a triangular locus, each swinging direction of the baton may be detected as the movement type, and a maximal value of the sensor output may be detected as the movement amount. As an example of the compensation by the compensation section, the detected movement amount corresponding to a lateral movement in the triangular-locus motion may be compensated in such a manner that the sensor output increases, with no compensation being made for the detected movement amount corresponding to a downward swinging movement of the baton (down-beat). This eliminates unevenness of the movement amounts caused by the operator's habit in swinging the baton. Because the control section controls the performance dynamics on the basis of the movement amount compensated by the compensation section, a performance according to dynamics contemplated by the operator can be achieved which is devoid of unwanted unevenness caused by the operator's habit.

The present invention also provides a tempo controlling apparatus which comprises a movement detection section for detecting a human operator's gesture to output detected movement information, an extraction section for extracting first and second characteristic points, out of the operator's gesture detected by the movement detection section, which relate to a swinging movement of the operator, and a control section for, whenever selected one of the first and second characteristic points is extracted by the extraction section, controlling a tempo of a performance on the basis of a time point at which the selected characteristic point has been extracted.

In the tempo controlling apparatus thus arranged, the operator's gesture in moving a baton is a swinging motion corresponding to musical time. In general, such a swinging motion presents different motion patterns corresponding to different types of musical time. For example, a two-four (2/4) time performance results in a simple reciprocative motion, and a three-four (3/4) time performance results in a triangular-locus motion. Such types of swinging motions have a common characteristic that the movement amount becomes uneven in a first stroke of the gesture because the motion involves a change of stroke direction. The unevenness is particularly visible in speed or acceleration of the gesture; that is, the speed is zero at the beginning of the first stroke, then reaches the maximum somewhere in the stroke, and then falls to zero at the end of the stroke where the direction of the stroke changes. For this reason, the tempo controlling apparatus of the invention is constructed to extract at least two different characteristic points (first and second characteristic points) and selects either of the extracted characteristic points so as to control the performance dynamics in synchronism with the selected characteristic point. Thus, an appropriate form of tempo control responsive to the operator's gesture can be selected in accordance with the operator's taste or capability. For example, if the operator is skilled in conducting, the zero-speed point in the hand-swinging motion may be set to coincide th a time point at which read address of performance sequence data is to be advanced. If, however, the operator is an ordinary user not skilled in conducting, the maximum-speed point may be set to coincide with the time point at which the read address of the performance sequence data is to be advanced, because some time delay in tone generation may be felt if the read address of the performance sequence data is advanced at the zero-speed point. In such a case, the minimal value at the zero-speed point and maximal value at the maximum-speed point in the first stroke of the gesture or swinging motion may be detected as the above-mentioned first and second characteristic points. Further, decision about which of the first and second characteristic points should be selected may be made by a mode selection.

Where the movement detection section comprises two angular speed sensors contained in the baton, the extraction section detects both the maximal value and minimal value in the sensor output. One of the extracted maximal and minimal values is selected, and the performance tempo is controlled on the basis of a time point at which the selected maximal or minimal value has been extracted. The tempo control may be executed in various forms, such as control of generation timing of tone to be performed, control of read address advancement of automatic performance sequence data and control of tempo clock pulses. In this manner, the tempo control (tone generation start control, read address advancement control of performance sequence data, variable control of tempo clock pulses, etc.), by a mode selection, at each selected point in a conducting motion stroke.

The present invention further provides a tempo controlling apparatus which comprises a movement detection section for detecting a human operator's gesture, an extraction section for extracting a characteristic point, out of the operator's gesture detected by the movement detection section, which relates to a swinging movement of the operator, and a control section for, whenever the characteristic point is extracted by the extraction section, controlling a tempo of a performance on the basis of a time point that is a predetermined time after the time point at which the characteristic point has been extracted. This arrangement achieves benefits similar to the above-mentioned, by setting, as a tempo controlling time point, a time point that is a predetermined time after the point at which the characteristic point has been extracted. Namely, even where the characteristic point to be extracted is just one of the maximal and minimal values, performance tempo control similar to the above-mentioned can be effected at an optional time point in the conducting motion stroke by variably setting the predetermined time.

BRIEF DESCRIPTION OF THE DRAWINGS

For better understanding of the above and other features of the present invention, the preferred embodiments of the invention will be described in detail below with reference to the accompanying drawings, in which.

DETAILED DESCRIPTION OF THE PREFERRED EMBODIMENTS

Figure 1:
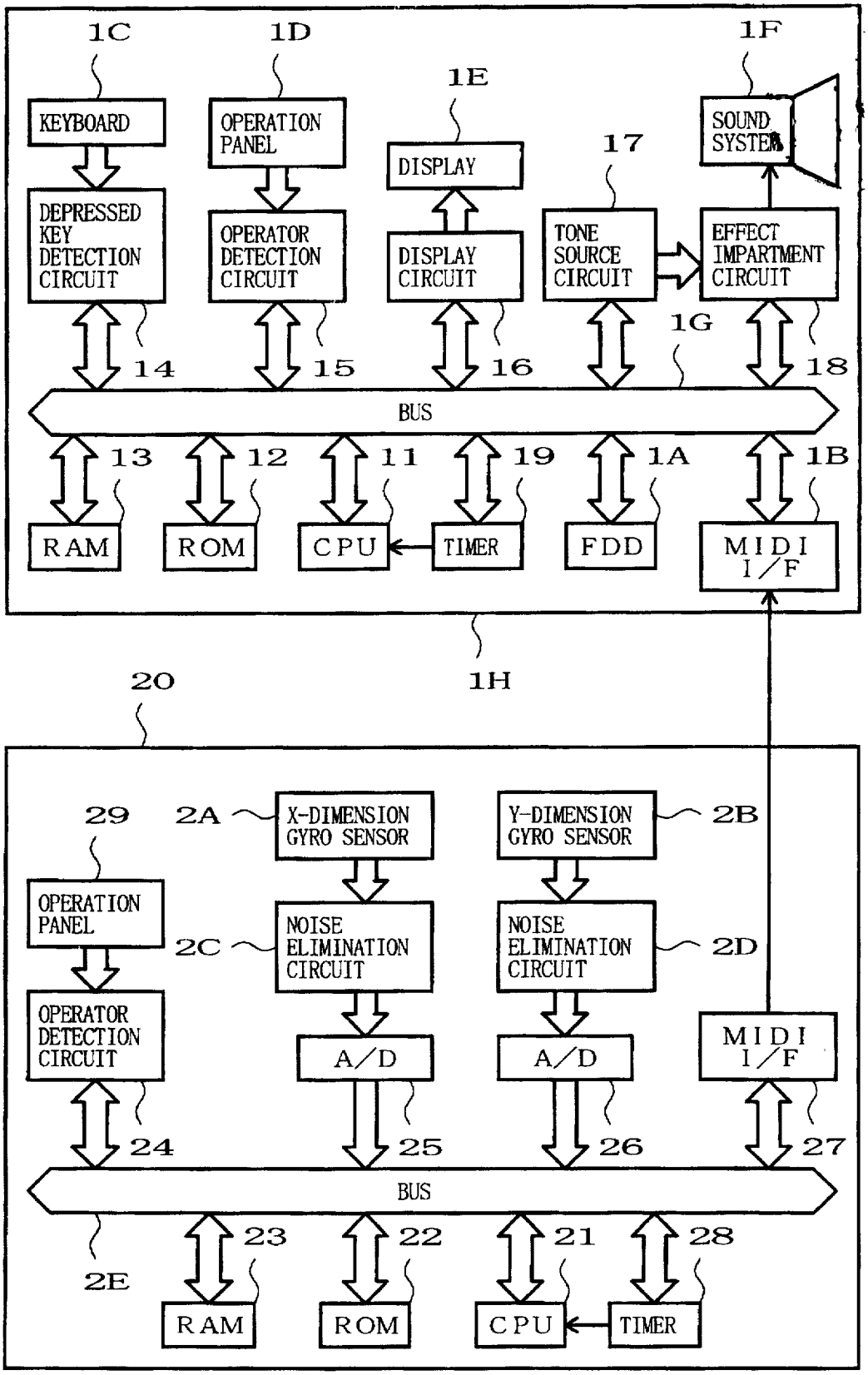
FIG. 1 is a schematic hardware block diagram of an embodiment of the present invention, showing detailed structures of and connection between an electronic musical instrument and a baton that provides the musical instrument with a tempo control signal corresponding to its swinging by the hand of a human operator.

FIG. 1 is a schematic hardware block diagram showing detailed structures of and connection between an electronic musical instrument 1H containing atone source circuit and an automatic performance device and a baton that provides the musical instrument 1H with a tempo control signal corresponding to its swinging motion effected by a human operator or player.

Referring first to the electronic musical instrument 1H, microprocessor unit or CPU 11 controls the entire operation of the electronic musical instrument 1H. To this CPU 11 are connected, via a bus 1G, a ROM 12, a RAM 13, a depressed key detection circuit 14, an operator detection circuit 15, a display circuit 16, a tone source circuit 17, an effect impartment circuit 18, a timer 19, a floppy disk drive (FDD) 1A, and a MIDI interface (I/F) IB.

Although the present invention is described here in relation to the electronic musical instrument where depressed key detection, transmission/reception of tempo control data, tone generation or sounding, etc. are performed by the CPU 11, it may also be applied to another type electronic musical instrument where a module comprising a depressed key detection circuit is provided separately from a module comprising a tone source circuit and where data exchange between the modules is effected via a MIDI interface.

The above-mentioned ROM 12, which is a read-only memory, has stored therein various control programs for the CPU 11 and various data.

The RAM 13 is allocated in predetermined address areas of a random access memory for use as various registers and flags for temporarily storing performance information and various data which are produced as the CPU 11 executes the programs.

Keyboard 1C has a plurality of keys for designating the pitch of tone to be generated and key switches provided in corresponding relations to the keys. If necessary, the keyboard 1C may also include key-touch detection section such as a key depression velocity or force detection device. The keyboard 1C is employed here just because it is a fundamental performance operator which is easy for music players to manipulate, but any other suitable performance operator such as drum pads may of course be employed.

The depressed key detection circuit 14, which comprises circuitry including a plurality of key switches corresponding to the keys on the keyboard 1C, outputs key-on event information upon detection of a new depressed key and key-off event information upon detection of a new released key. The depressed key detection circuit 14 also generates key touch data by determining the key depression velocity or force and outputs the generated touch data as velocity data. Each of the key-on and key-off event information and velocity information is expressed on the MIDI standards and contains data indicative of the key code of the depressed or released key and channel to which the key is assigned.

Operation panel 1D includes an automatic performance start/stop switch, a temporary stop (pause) switch and a variety of other operators or switches for selecting, setting and controlling the color, volume, effect etc. of each tone to be generated. Details of the operation panel 1D will not be described here because they are known in the art. The operator detection circuit 15 detects an operational condition of each of the operators to provide switch event information corresponding to the detected condition to the CPU 11 via the bus 1G.

The display circuit 16 shows on a display 1E various information such as the controlling conditions of the CPU 11 and contents of setting data, and the display 1E comprises for example a liquid crystal device (LCD) that is controlled by the display circuit 16.

The tone source circuit 17 has a plurality of tone generation channels, by means of which it is capable of generating plural tones simultaneously. The tone source circuit 17 receives performance information (data complying with the MIDI standards) supplied via the bus 1G, and it generates tone signals on the basis of the received data. Any tone signal generation method may be used in the tone source circuit 17 depending on an application intended. For example, any conventionally known tone signal generation method may be used such as: the memory readout method where tone waveform sample value data stored in a waveform memory are sequentially read out in accordance with address data that change in correspondence to the pitch of tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter.

The effect impartment circuit 18 imparts various effects to the tone signals from the tone source circuit 17 and outputs the effect-imparted tone signals to a sound system 1F, where the signals are audibly reproduced or sounded via amplifiers and speakers.

The timer 19 generates clock pulses to count time intervals and to determine a tempo of an automatic performance, and the clock pulses are given to the CPU 11 as timer interrupt instructions, in response to which the CPU 11 performs various processes as timer interrupt processes as will be later described.

The floppy disk drive (FDD) 1A works as an interface for introducing into the electronic musical instrument 1H automatic performance data from an external storage medium, i.e., floppy disk and for writing into the floppy disk the automatic performance data processed in the musical instrument 1H.

The MIDI interface 1B interconnects the bus 1G of the electronic musical instrument 1H and a MIDI interface 27 of the baton 20, and the baton MIDI interface 27 interconnects a bus 2E of the baton 20 and the MIDI interface 1B of the musical instrument 1H. Thus, the musical instrument's bus 1G and baron's bus 2E are interconnected via the MIDI interfaces 1B and 27 so that data complying with the MIDI standards can be exchanged bidirectionally between the instrument 1H and baton 20.

Next, the structure of the baton 20 will be described below.

Microprocessor unit or CPU 21 controls the entire operation of the baton 20. To this CPU 21 are connected, via the bus 2E, a ROM 22, a RAM 23, an operator detection device 24, A/D converters 25 and 26, the MIDI interface 27, and a timer 28.

The above-mentioned ROM 22, which is a read-only memory, has stored therein various control programs for the CPU 21 and various data.

The RAM 23 is allocated in predetermined address areas of a random access memory for temporarily storing various data which are produced as the CPU 21 executes the programs.

Switches 29 includes an ON/OFF switch for the baton 20, delay time switches for adjusting output timing of tempo control signals, etc. The operator detection circuit 24 detects the operational state of each of the switches 29 and provides data corresponding to the detected operational state to the CPU 21 via the bus 2E.

X-dimension and Y-dimension piezoelectric gyro sensors 2A and 2B are piezoelectric vibrating gyro sensors which are provided along two orthogonal axes (X and Y axes), and each of the gyro sensors 2A and 2B, when it rotates about its rotational axis, outputs voltage corresponding to Coriolis force proportional to the angular speed of the rotation. Thus, X-axis angular speed $\omega X$ can be determined on the basis of the voltage output from the X-dimension piezoelectric gyro sensors 2A, while Y-axis angular speed $\omega Y$ can be determined on the basis of the voltage output from the Y-dimension piezoelectric gyro sensors 2B.

Noise elimination circuits 2C and 2D are provided to eliminate noise components contained in sensor output signals from the X-dimension and Y-dimension piezoelectric gyro sensors 2A and 2B and comprise low-pass filters for removing high-frequency components that exceed their response frequency.

The A/D converters 25 and 26, provided in corresponding relations to the gyro sensors 2A and 2B, convert into digital representation the respective sensor output signals having the high-frequency components removed therefrom. The converted digital signals from the converters 25 and 26 are read out by the CPU 21 at a predetermined frequency and subjected to predetermined data processing so as to be used in determination processes of the baton 20 as will be later described.

The timer 28 generates clock pulses which are given to the CPU 21 as interrupt instructions, so that the CPU 21 detects an operational state of the baton 20 by interrupt processing and, in response to the detected operational state, outputs a tempo control signal for determining an automatic performance tempo to the electronic musical instrument 1H via the MIDI interfaces 27 and 1B.

Now, with reference to flowcharts of FIGS. 2 to 10, a description will be made about examples of processes which are executed by the microcomputer (CPU 21) of the baton 20 in order to implement a performance dynamics control function according to a first embodiment of the present invention.

Figure 2:
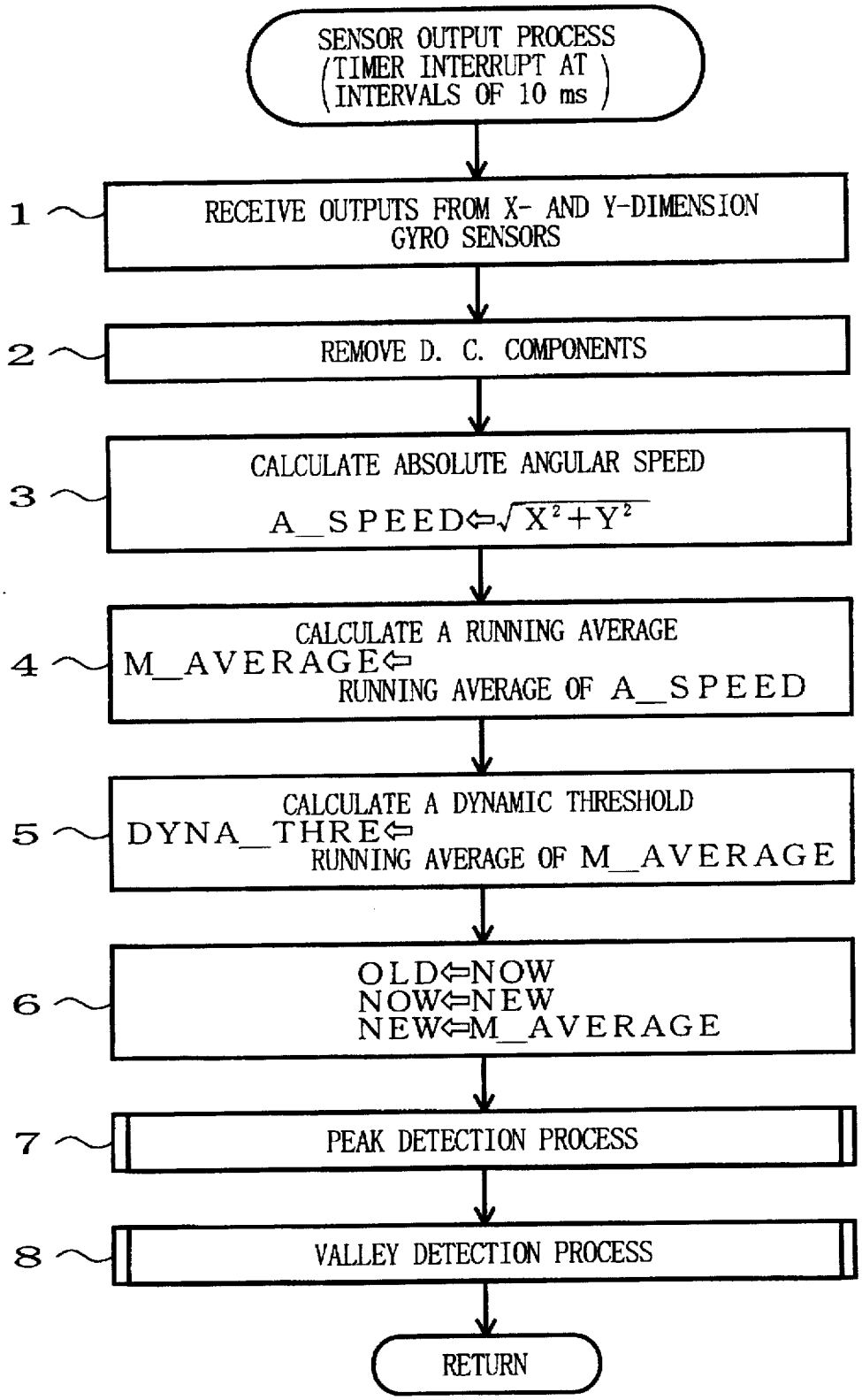
FIG. 2 is a flowchart illustrating an example of a sensor output process executed by a microcomputer within the baton of FIG. 1 to practice a first embodiment of the present invention.

FIG. 2 illustrates an example of a sensor output process executed by the microcomputer (CPU 21) of the baton 20, which is a timer interrupt process performed in synchronism with the operation clock pulses (generated at intervals of about 10 ms) received from the timer 28. This sensor output process is carried out in the following step sequence in accordance with the control program stored in the program ROM 22.

Step 1: Via the bus 2E, the CPU 21 receives output signals from the X-dimension and Y-dimension piezoelectric gyro sensors 2A and 2B, namely, digital signals output from the A/D converters 25 and 26.

Step 2: D.C. components are removed from the received digital signals by passing them through a high-pass filter having a low cut-off frequency. Because, when the human operator operating the baton 20 makes a slow circling motion of the baton 20 other than predetermined swinging motion, there may be produced D.C. components, i.e., drift components corresponding to the slow circling motion.

Step 3: An absolute angular speed is calculated on the basis of the respective outputs X and Y of the gyro sensors 2A and 2B from which direct current components have been removed, and the calculated absolute angular speed is stored into an absolute angular speed register A_SPEED. Specifically, the absolute angular speed is obtained by computing the square root of the sum of squared outputs X and Y, as shown in an arithmetic expression at step 3 of FIG.

Figure 12:
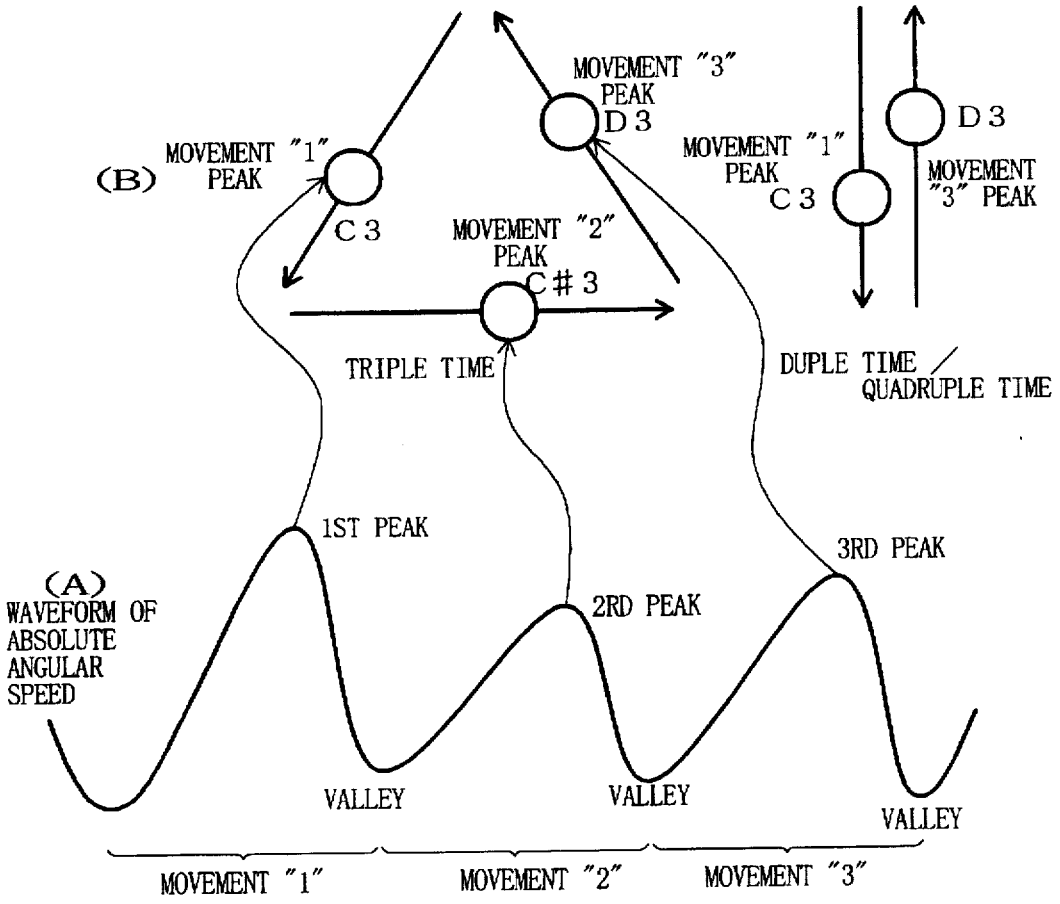
FIG. 12 is a conceptual diagram of the sensor output process when the baton is swung by the human operator in triple time in such a manner to draw a triangular locus.

2. By plotting time-varying values of the absolute angular speed calculated at this step using the horizontal axis as a time axis, a curve as shown in part (A) of FIG. 12 is obtained.

Step 4: The absolute angular speed values calculated at consecutive timer interrupt points, from the current point to the point that is m (m is a predetermined number) points before the current point, are averaged, and then the resultant average is stored into a movement average register M_AVERAGE as a movement average value. If, for example, the number "m" is 8, then the movement average value is obtained by adding together eight absolute angular speed values calculated at eight consecutive interrupt points and dividing the resultant sum by eight.

Step 5: The movement average values calculated by the operation of step 4 at consecutive timer interrupt points, from the current point to the point that is n (n is a predetermined number) points before the current point and stored in the movement average register M_AVERAGE, are averaged, and then the resultant average is stored into a dynamic threshold value register DYNA_THRE as a dynamic threshold value.

Step 6: Stored value in a last-value register NOW is set into a value-before-last register OLD, stored value in a current-value register NEW is set into the last-value register NOW, and the movement average value calculated at the current point (i.e., stored value in the movement average register M_AVERAGE) is set into the current-value register NEW. That is, the stored values in the value-before-last register OLD, last-value register NOW and current-value register NEW are shifted to respective new values.

Figure 3:
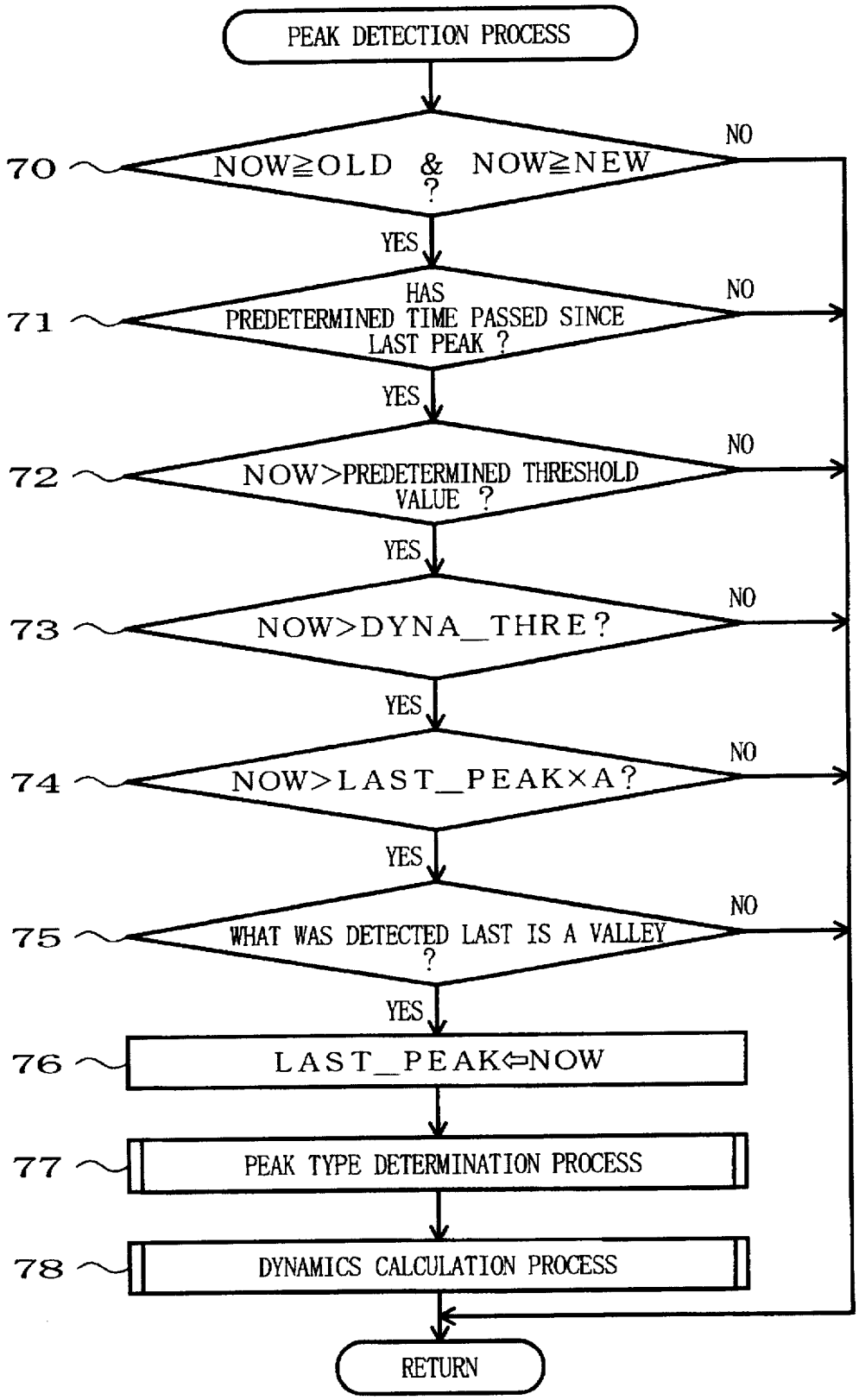
FIG. 3 is a flowchart illustrating a detail of a peak detection process of FIG. 2.

Step 7: Peak detection process is performed on the basis of the respective stored values in the value-before-last register OLD, last-value register NOW and current-value register NEW. FIG. 3 illustrates a detail of the peak detection process, which is carried out in the following step sequence.

Step 70: A determination is made as to whether or not the stored value in the last-value register NOW is equivalent to or greater than the stored values in the value-before-last register OLD and current-value register NEW, i.e., whether the movement average value detected at the last (i.e., most recent) timer interrupt point is a maximal value (peak) or not. If so (YES), the CPU 21 proceeds to next step 71, but if not, the CPU 21 goes to step 8 of FIG. 2.

Step 71: Now that the movement average value detected at the last timer interrupt point is a peak as determined at step 70, a further determination is made here as to whether a predetermined time has passed from the last peak determination to the current peak determination. If answered in the affirmative, the CPU 21 proceeds to next step 72, but if answered in the negative, the CPU 21 goes to step 8 of FIG. 2. This is because the peak detected at step 70 when the predetermined time has not passed from the last peak determination is an incorrect peak caused by a disordered motion of the baton 20 by the human operator.

Step 72: A determination is made as to whether or not the stored value in the last-value register NOW is greater than a predetermined threshold value. If answered in the affirmative, the CPU 21 proceeds to next step 73, but if answered in the negative, the CPU 21 goes to step 8 of FIG. 2. Namely, if the stored value in the last-value register NOW is not greater than the predetermined threshold value, it means that the peak detected at steps 70 and 71 is a pseudo peak caused by disordered motion of the baton 20 by the human operator.

Step 73: A determination is made as to whether or not the stored value in the last-value register NOW is greater than the dynamic threshold value calculated at step 5 of FIG. 2 and stored in the register DYNA_THRE. If so, the CPU 21 proceeds to next step 74, but if not, the CPU 21 goes to step 8 of FIG. 2. This is because peak values are always greater than the dynamic threshold value.

Step 74: A determination is made as to whether or not the stored value in the last-value register NOW is greater than a value obtained by multiplying the stored value in a last-peak register LAST_PEAK by a predetermined coefficient smaller than "1". If answered in the affirmative, the CPU 21 proceeds to next step 75, but if not, the CPU 21 goes to step 8 of FIG. 2. This is because it is considered that each current peak generally takes a value approximate to a last (most recent) peak.

Step 75: A determination is made as to whether what was detected in the peak or valley detection process preceding the current timer interrupt point is a valley or not. If what was detected in the last peak or valley detection process is a valley (YES), then the peak detected at the current timer interrupt point is considered as a correct peak, and thus the CPU 21 proceeds to next step 76. If, on the other hand, what was detected in the last peak or valley detection process is a peak (NO), the peak detected at the current timer interrupt point is considered as an incorrect peak because two peaks can not occur consecutively, and thus the CPU 21 goes to step 8 of FIG. 2.

Step 76: The stored value in the last-value register NOW is set into the last-peak-value register LAST_PEAK.

Step 77: Peak type determination process is performed to determine what type of the baton movement or stroke the currently detected peak is related to, i.e., determine a direction of the baton movement or stroke by the human operator which has caused the peak detected at steps 70 to 75.

Figure 4:
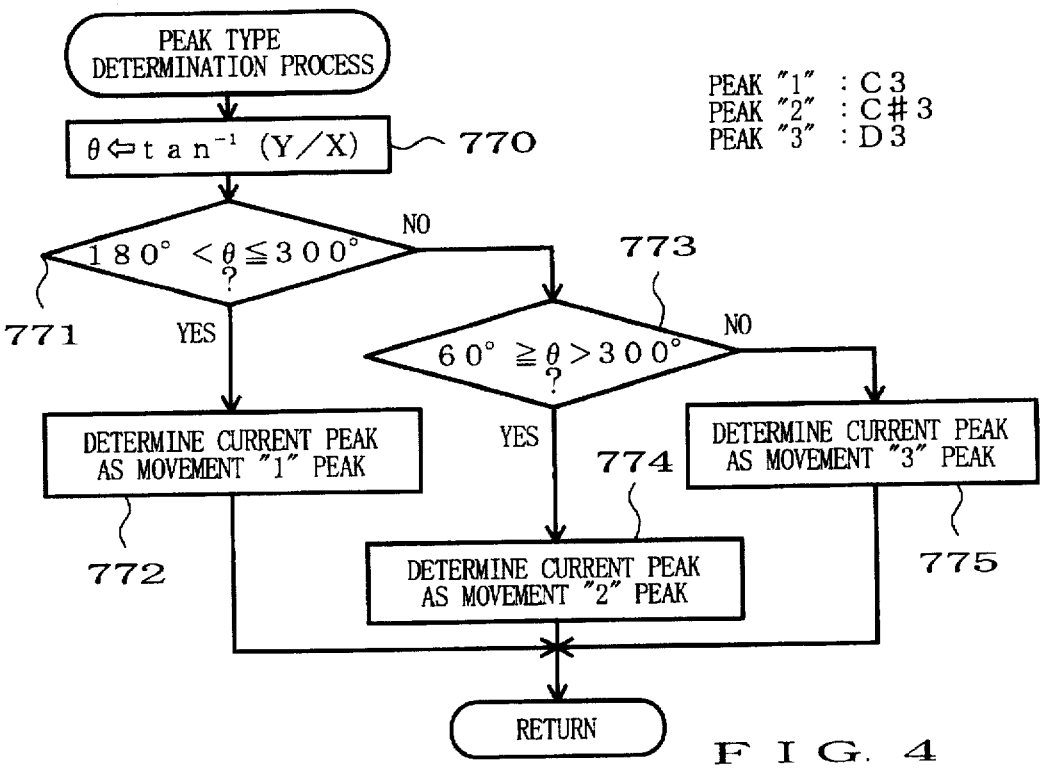
FIG. 4 is a flowchart illustrating a detail of a peak type determination process of FIG. 3.

FIG. 4 is a flowchart illustrating a detail of the peak type determination process, which is carried out in the following step sequence.

Step 770: The angle of the baton movement is calculated on the basis of the respective outputs X and Y of the gyro sensors 2A and 2B from which D.C. components have been removed, and the calculated absolute angular speed is stored into an angle register θ. Specifically, the angle is obtained from by the arc tangent of a value calculated by dividing the output Y by the output X, as shown in an arithmetic expression at step 770 of FIG. 4.

Step 771: It is determined whether the stored value in the angle register θ is greater than 180° and is also equivalent to or smaller than 300°. If answered in the affirmative, the CPU 21 proceeds to step 772; otherwise, the CPU 21 branches to step 773.

Step 772: Because the current peak has been caused by the human operator's swinging movement of type "1" as will be described below, it is classified as a type "1" peak.

Step 773: It is determined whether the stored value in the angle register θ is equivalent to or smaller than 60° and is also greater than 300°. If answered in the affirmative, the CPU 21 proceeds to step 774; otherwise, the CPU 21 branches to step 775.

Step 774: Because the current peak has been caused by the human operator's swinging movement of type "2", it is classified as a type "2" peak as will be described below.

Step 775: Because the negative determinations at steps 771 and 773 mean that the stored value in the angle register θ is equivalent to or smaller than 180° and is also greater than 60°, namely that the current peak has been caused by the human operator's swinging movement of type "3" as will be described below, and thus it is classified as a type "3" peak.

Figure 11:
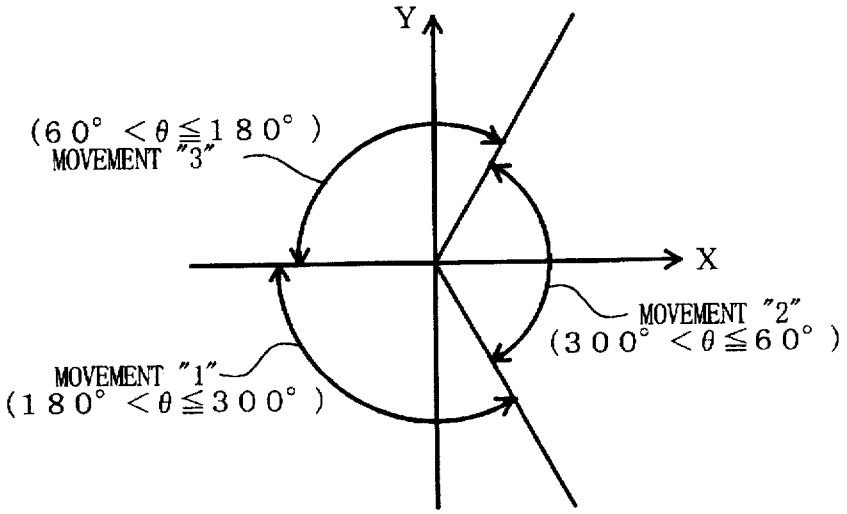
FIG. 11 is a diagram explanatory of relationships between angles θ calculated by an arithmetic expression, and types of swinging movement of the baton.

FIG. 11 is a diagram explanatory of relationships between angles θ calculated by the arithmetic expression of step 770 and types "1", "2", "3" of swinging movement of the baton 20. As shown, the determination that the angle θ is greater than 180° and is also equivalent to or smaller than 300° ("YES" determination at step 771) means that the baton 20 has been moved in the direction of movement "1"; the determination that the angle θ is equivalent to or smaller than 60° and is also greater than 300° ("YES" determination at step 773) means that the baton 20 has been swung in the direction of movement "2"; and the determination that the angle θ is equivalent to or smaller than 180° and is also greater than 60° ("NO" determination at step 773) means that the baton 20 has been moved in the direction of movement "3".

It should be understood that the peak type determination may be made in any other manner than the above-mentioned, e.g., in consideration of the type of the last peak and/or angle difference between the current and last peaks.

Referring back to FIG. 3, at step 78, one of dynamics calculation processes I to V is performed on the basis of the current detected peak value so as to calculate performance dynamics, and then the CPU 21 goes to step 8 of FIG. 2. The dynamics calculation processes I to V will be described in detail later.

Figure 5:
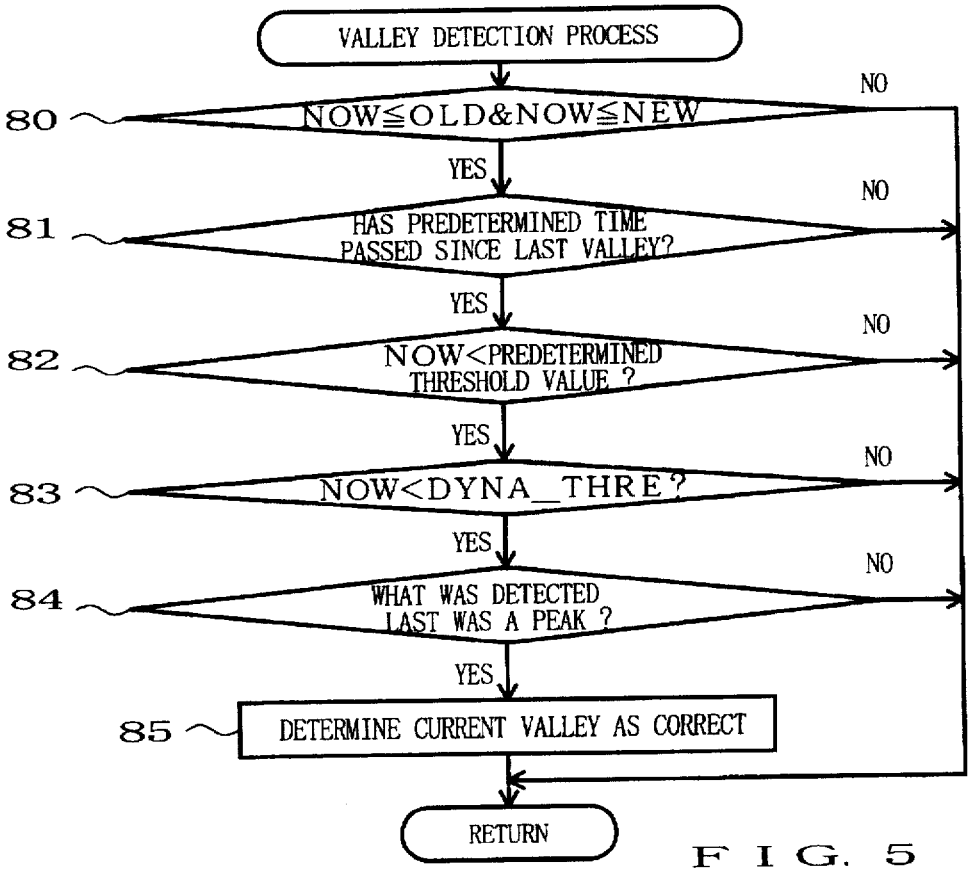
FIG. 5 is a flowchart illustrating a detail of a valley detection process of FIG. 2.

At step 8 of FIG. 2, a valley detection process is performed on the basis of the respective stored values in the value-before-last register OLD, last-value register NOW and current-value register NEW. FIG. 5 illustrates a detail of such a valley detection process, which is carried out in the following step sequence.

Step 80: A determination is made as to whether or not the stored value in the last-value register NOW is equivalent to or smaller than the stored values in the value-before-last register OLD and current-value register NEW, i.e., whether the movement average value detected at the last timer interrupt point is a minimal value (valley) or not. If so (YES), the CPU 21 proceeds to next step 81, but if not, the CPU 21 returns and waits until a next timer interrupt point.

Step 81: Now that the movement average value detected at the last timer interrupt point is a valley as determined at step 80, a further determination is made here as to whether a predetermined time has passed from the last valley determination to the current valley determination. If answered in the affirmative, the CPU 21 proceeds to next step 82, but if answered in the negative, the CPU 21 returns and waits until a next timer interrupt point because the current valley determination is considered to be incorrect.

Step 82: A determination is made as to whether or not the stored value in the last-value register NOW is smaller than a predetermined threshold value. If answered in the affirmative, the CPU 21 proceeds to next step 83, but if answered in the negative, the CPU 21 returns and waits until a next timer interrupt point because the current valley determination is considered to be incorrect.

Step 83: A determination is made as to whether or not the stored value in the last-value register NOW is smaller than the dynamic threshold value stored in the register DYNA_THRE. If so, the CPU 21 proceeds to next step 84, but if not, the CPU 21 returns and waits until a next timer interrupt point because the current valley determination is considered to be incorrect.

Step 84: A determination is made as to whether what was detected in the peak or valley detection process preceding the current timer interrupt point is a peak or not. If what was detected in the last peak or valley detection process is a peak (YES), then the valley detected at the current timer interrupt point is considered as a correct valley, and thus the CPU 21 proceeds to next step 85. If, on the other hand, what was detected in the last peak or valley detection process is a valley (NO), the valley detected at the current timer interrupt point is considered as an incorrect valley because two valleys can not occur consecutively, and thus the CPU 21 returns and waits until a next timer interrupt point.

Step 85: The current detected minimal valley is determined as a correct valley.

After the valley detection, the peak detection process of FIG. 3 is executed to detect a peak. That is, by performing the peak detection process of FIG. 3 and the valley detection process of FIG. 5 in an alternate fashion, peak and valley can be detected reliably.

Next, a detailed description will be made about dynamics calculation processes I to V of step 78 of FIG. 3, with reference to FIGS. 6 to 10.

Figure 6:
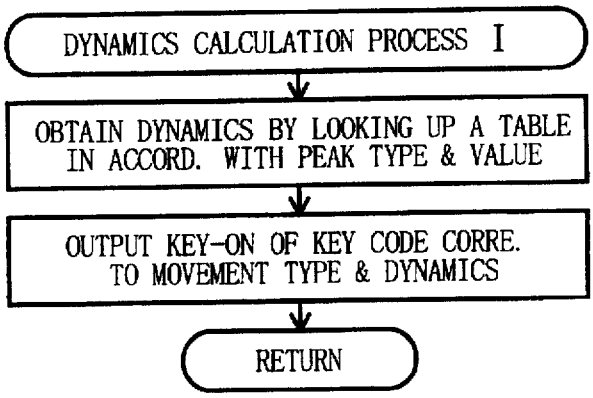
FIG. 6 is a flowchart illustrating a detail of dynamics calculation process I which is one example of dynamics calculation processing of FIG. 3.

In dynamics calculation process I of FIG. 6, the peak value detected in the peak detection process of FIG. 3 is converted by looking up a table which corresponds to the peak type determined in the peak type type determination process of FIG. 4; the table is one of three tables prepared in corresponding relations to peak types (i.e., movement or stroke types) "1", "2" and "3". The thus-converted peak value is output as performance dynamics.

Figure 7:
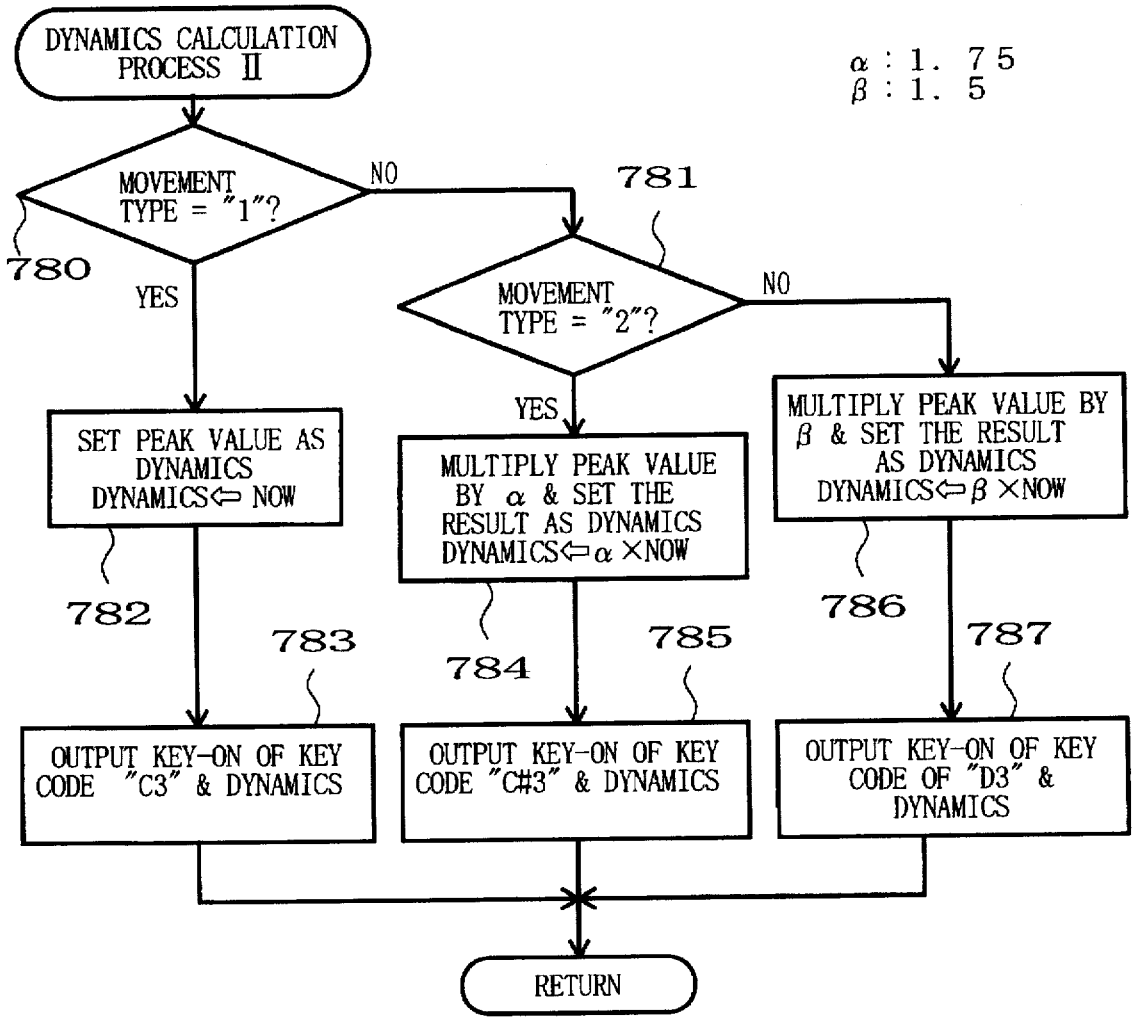
FIG. 7 is a flowchart illustrating a detail of dynamics calculation process II which is another example of the dynamics calculation processing of FIG. 3.

In dynamics calculation process II of FIG. 7, the peak value detected in the peak detection process of FIG. 3 is multiplied by a coefficient which corresponds to the peak type determined in the peak type determination process of FIG. 4, so as to calculate performance dynamics; the coefficient is one of coefficients prepared in corresponding relations to peak types (i.e., movement types) "1", "2" and "3". This dynamics calculation process II is carried out in the following step sequence.

Step 780: A determination is made as to whether the peak type, i.e., movement type determined in the peak type determination process of FIG. 4 is "1". If it is "1" (YES), the CPU 21 proceeds to step 782, but if it is "2" or "3" (NO), the CPU 21 branches to step 781.

Step 781: It is further determined whether the peak type, i.e., movement type determined in the peak type determination process of FIG. 4 is "2". If it is "2" (YES), the CPU 21 proceeds to step 784, but if it is "3" (NO), the CPU 21 branches to step 786.

Step 782: Now that the peak has been determined as that of movement type "1" at step 780, the peak value is set as performance dynamics; that is, the peak value presently stored in the last-value register NOW is set as performance dynamics into the dynamics register DYNAMICS. At this step, the coefficient is set at "1.0".

Step 783: Key-on signal of key code "C3" corresponding to movement type "1" is output along with the performance dynamics obtained at step 782.

Step 784: Now that the peak has been determined as that of movement type "2" at step 781, the peak value is multiplied by coefficient "α" and then set as performance dynamics. Namely, the peak value presently stored in the last-value register NOW is multiplied by coefficient "α", and the multiplication result (α×NOW) is set as performance dynamics into the dynamics register DYNAMICS.

Step 785: Key-on signal of key code "C#3" corresponding to movement type "2" is output along with the performance dynamics obtained at step 784.

Step 786: Now that the peak has been determined as that of movement type "3" at step 781, the peak value is multiplied by coefficient "β" and then set as performance dynamics. Namely, the peak value presently stored in the last-value register NOW is multiplied by coefficient "β", and the multiplication result (β×NOW) is set as performance dynamics into the dynamics register DYNAMICS.

Step 787: Key-on signal of key code "D3" corresponding to movement type "3" is output along with the performance dynamics obtained at step 786.

Figure 8:
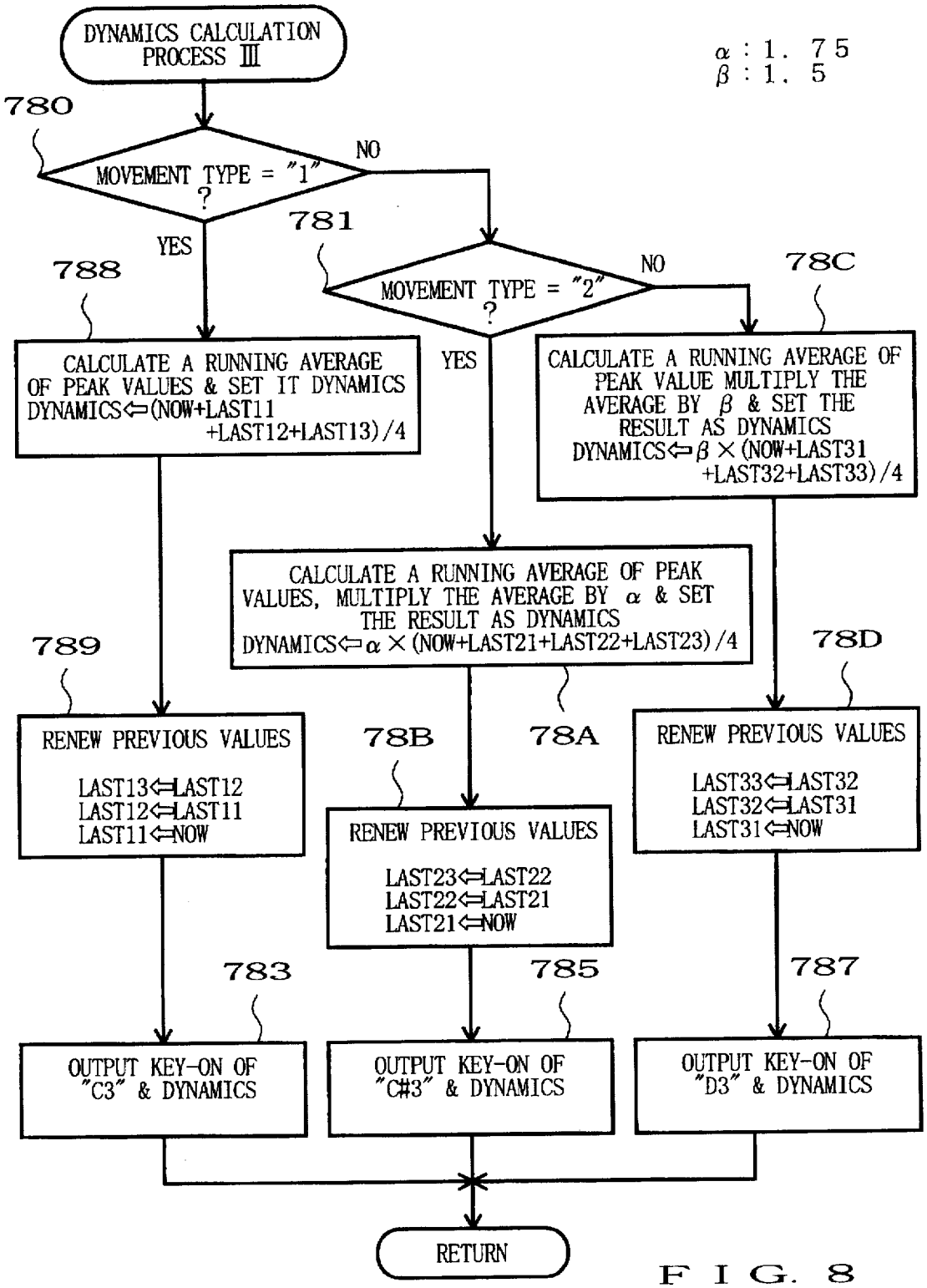
FIG. 8 is a flowchart illustrating a detail of dynamics calculation process III which is another example of the dynamics calculation processing of FIG. 3.

In dynamics calculation process III of FIG. 8, a movement average is calculated for each of movement types "1", "2" and "3", and the movement average is multiplied by a coefficient which corresponds to the determined peak type so as to calculate performance dynamics; the coefficient is one of those prepared in corresponding relations to peak types (i.e., movement types) "1", "2" and "3" similarly to the process of FIG. 7. In FIG. 8, blocks denoted by the same step numbers as in FIG. 7 represent the same operations as in the figure and will not be described here to avoid unnecessary duplication.

Step 788: Now that the peak has been determined as that of movement type "1" at step 780, a movement average is calculated of peak values so far detected for movement type "1" and the calculated movement average is set as performance dynamics. That is, the stored values in the last-value register NOW and value-before-last register LAST11, second-value-from-last register LAST12 and third-value-from-last register LAST13 (these registers LAST11, LAST12 and LAST13 storing three peak values detected for movement type "1" prior to the peak value storage into the last-value register NOW) are added together and then divided by 4, so that the calculate movement average value ((NOW+LAST11+LAST12+LAST13)/4) is stored into the dynamics register DYNAMICS.

Step 789: In preparation for next execution of dynamics calculation process III, the values in the registers LAST11, LAST12 and LAST13 for movement type "1" are renewed; that is, the stored value in the second-value-from-last register LAST12 is set into the third-value-from-last register LAST13; the stored value in the value-before-last register LAST11 is set into the second-value-from-last register LAST12; and the stored value in the last-value register NOW is set into the value-before-last register LAST11.

Step 78A: Now that the peak has been determined as that of movement type "2" at step 781, a movement average is calculated of peak values so far detected for movement type "2" and the calculated movement average is multiplied by coefficient α and then set as performance dynamics. That is, the stored values in the last-value register NOW and value-before-last register LAST21, second-value-from-last register LAST22 and third-value-from-last register LAST23 (these registers LAST21, LAST22 and LAST23 storing three peak values detected for movement type "2" prior to the peak value storage into the last-value register NOW) are added together and then divided by 4 and the resultant average is multiplied by coefficient α, so that the multiplication result (α×(NOW LAST21+LAST22+LAST23)/4) is stored into the dynamics register DYNAMICS.

Step 78B: In preparation for next execution of dynamics calculation process III, the values in the registers LAST21, LAST22 and LAST23 for movement type "2" are renewed in a similar manner to the above-mentioned step 789.

Step 78C: Now that the peak has been determined as that of movement type "3" at step 781, a movement average is calculated of peak values so far detected for movement type "3" and the calculated movement average is multiplied by coefficient β and then set as performance dynamics. That is, the stored values in the last-value register NOW and value-before-last register LAST31, second-value-from-last register LAST32 and third-value-from-last register LAST33 (these registers LAST31, LAST32 and LAST33 storing three peak values detected for movement type "3" prior to the peak value storage into the last-value register NOW) are added together and then divided by 4 and the resultant average is multiplied by coefficient β, so that the multiplication result (β×(NOW+LAST31+LAST32+LAST33)/4) is stored into the dynamics register DYNAMICS.

Step 78D: In preparation for next execution of dynamics calculation process III, the values in the registers LAST31, LAST32 and LAST33 for movement type "3" are renewed in a similar manner to the above-mentioned step 789.

Figure 9:
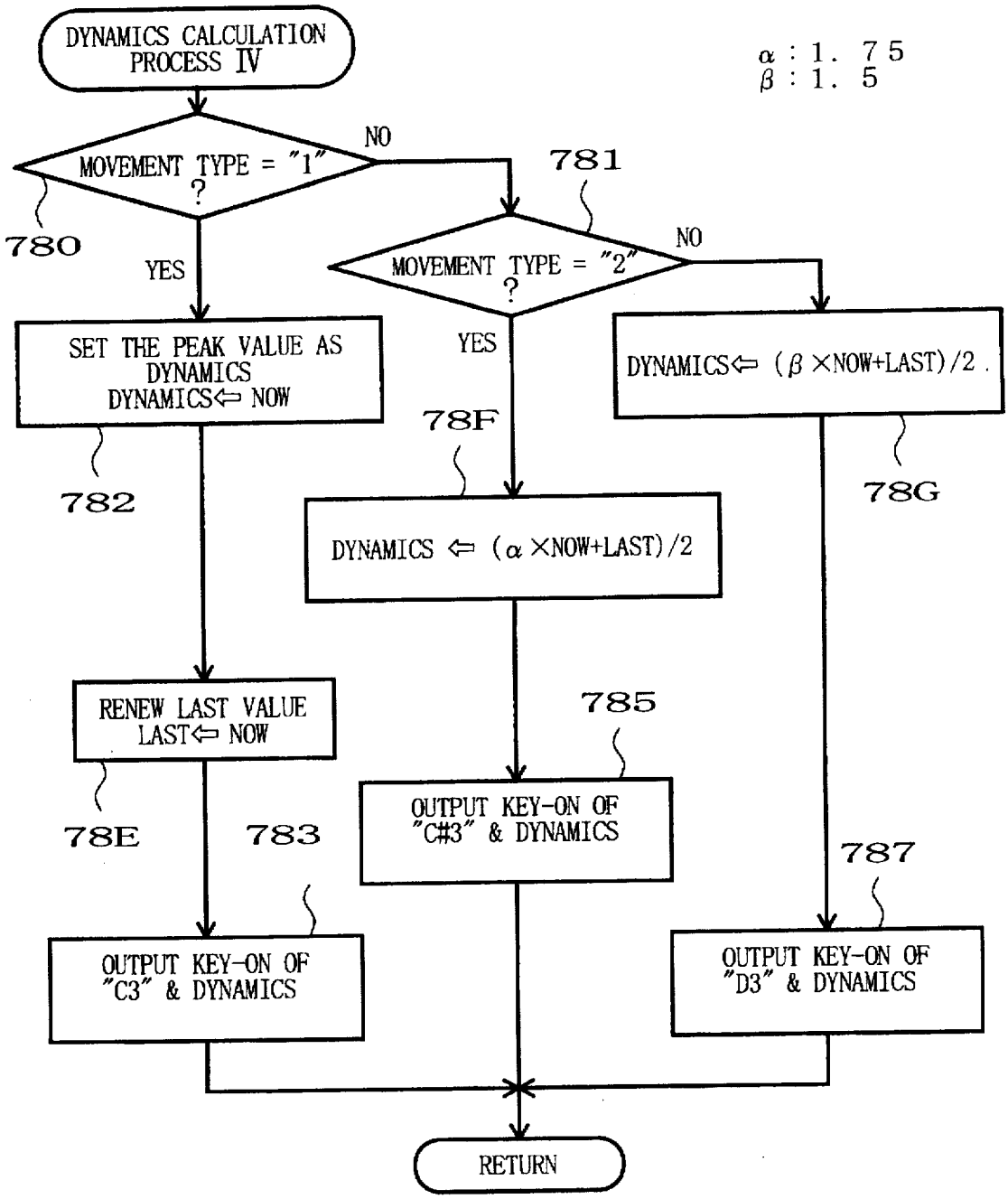
FIG. 9 is a flowchart illustrating a detail of dynamics calculation process IV which is still another example of the dynamics calculation processing of FIG. 3.

In dynamics calculation process IV of FIG. 9, performance dynamics are calculated by multiplying the peak value by a coefficient which corresponds to movement type "1", "2" or "3" and also, for movement types "2" and "3", calculating an average of the multiplication result and peak value of movement type "1". In FIG. 9, blocks denoted by the same step numbers as in FIG. 7 represent the same operations as in the figure and will not be described here to avoid unnecessary duplication.

Step 78E: The peak value stored in the last register NOW, i.e., peak value for movement type "1" is set into the value-before-last register LAST, because an average of the multiplication result and peak value of movement type "1" is calculated for movement types "2" and "3" while the same operation as in dynamics calculation process II of FIG. 7 is executed for movement type "1".

Step 78F: Now that the peak has been determined as that of movement type "2" at step 781, the peak value is multiplied by coefficient α, an average is calculated of the multiplication result and the last peak value of movement type "1", and the calculated average is set as performance dynamics. That is, the stored peak value in the last-value register NOW is multiplied by coefficient a, and the multiplication result and the peak value stored in the value-before-last register LAST are summed and then divided by 2, so that the resultant average ((α×NOW+LAST)/2) is stored into the dynamics register DYNAMICS.

Step 78G: Now that the peak has been determined as that of movement type "3" at step 781, the peak value is multiplied by coefficient β, an average is calculated of the multiplication result and the last peak value of movement type "1", and the calculated average is set as performance dynamics. That is, the stored peak value in the last-value register NOW is multiplied by coefficient β, and the multiplication result and the peak value stored in the value-before-last register LAST are summed and then divided by 2, so that the resultant average ((β×NOW+LAST)/2) is stored into the dynamics register DYNAMICS.

Figure 10:
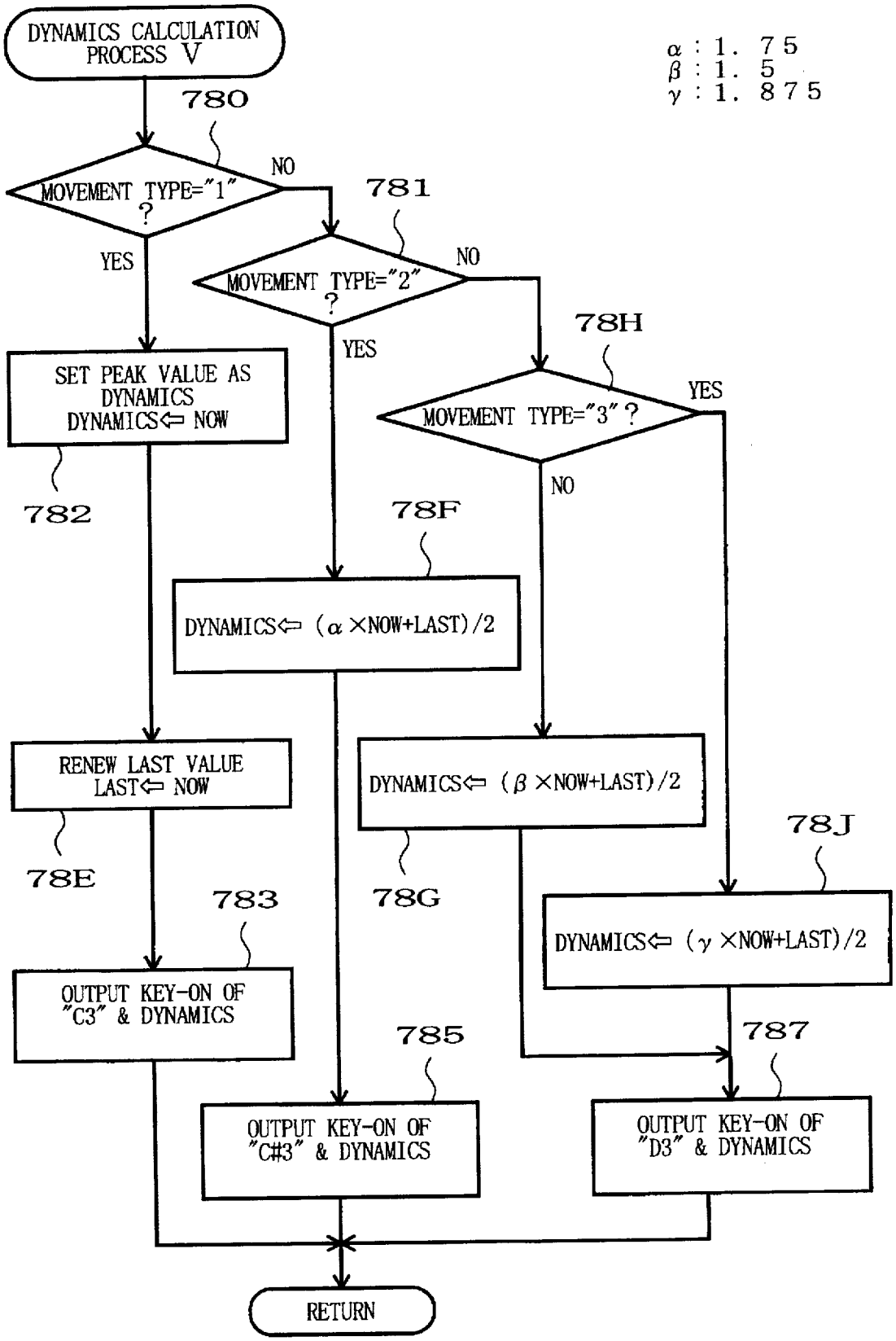
FIG. 10 is a flowchart illustrating a detail of dynamics calculation process V which is still another example of the dynamics calculation processing of FIG. 3.

In dynamics calculation process V of FIG. 10, performance dynamics are calculated by multiplying the peak value by a coefficient which corresponds to movement type "1", "2" or "3" and also, for movement types "2" and "3", calculating an average of the multiplication result and peak value of movement type "1", in a similar manner to dynamics calculation process IV of FIG. 9. In addition, for movement type "3", the value of the coefficient is changed depending on whether the type of the last peak (last movement type) is "1" or "2". This is because peaks of movement "1" and "2" occur alternately when vertical (upward/downward) motion of the baton 20 is effected in duple or quadruple time while peaks of movement "1", "2" and "3" occur cyclically when triangular motion of the baton 20 is effected in triple time. Thus, output values of the angular speed sensors will differ between a time when movement "1" changes to movement "3" and a time when movement "2" changes to movement "3". For such a reason, this process applies different coefficient values for the vertical (upward/downward) motion and triangular motion. In FIG. 10, blocks denoted by the same step numbers as in FIG. 9 represent the same operations as in the figure and will not be described here to avoid unnecessary duplication.

Step 78H: Now that the peak has been determined as that of movement type "3" at step 781, it is further determined whether the last movement type is "1" or not. If it is "1" (YES), the CPU 21 goes to step 78J, but if it is "2", the CPU 21 goes to step 78G.

Step 78J: Now that the last movement type has been determined as "1" at step 78H, the type "3" peak value is multiplied by coefficient γ, an average is calculated of the multiplication result and the last peak value of movement type "1", and the calculated average is set as performance dynamics. That is, the stored peak value in the last-value register NOW is multiplied by coefficient γ, and the multiplication result and the peak value stored in the value-before-last register LAST are summed and then divided by 2, so that the resultant average ((γ×NOW+LAST)/2) is stored into the dynamics register DYNAMICS.

In view of the fact that a greatest peak value results from the downward movement of the baton 20 while a smallest peak value results from the upward movement of the baton 20, coefficients α for the upward movement (movement type "3") and lateral movement (movement type "2") in the triangular-locus motion and upward movement (movement type "3") in the vertical motion amy be set, for example, to 1.75, 1.5 and 1.875, respectively, so that uniform performance dynamics can be achieved as a whole. These coefficient values are only illustrative, and other values may of course be set as desired by individual users.

FIG. 12 illustrates how a sensor output process is performed in response to a motion of the baton 20 effected by the human operator, and more specifically, FIG. 12 is a conceptual diagram of the sensor output process when the baton 20 is moved by the operator in triple time in such a manner to draw a triangular locus. Part (A) of FIG. 12 illustrates a waveform output as the baton 20 is moved in a triangular-locus motion of triple time, and part (B) of FIG. 12 illustrates peak detection points of the absolute angular speed in the triangular-locus motion.

When the baton 20 is moved in a triangular locus as shown in part (B) of FIG. 12, absolute angular speed values calculated at step 3 of FIG. 2 present a waveform as shown in part (A) of FIG. 12. As shown, peak and valley occur alternately in order of a first peak, a valley, a second peak, a valley, a third peak and a valley.

When the baton 20 is first moved obliquely to a 240° position (to the lower left) in FIG. 11, the first peak is detected by the operations of steps 70 to 75 of FIG. 3, and the stored value in the last-value register NOW is set into the last-peak-value register LAST_PEAK. Also, the first peak is determined as a peak of movement "1" by the operation of step 771 of FIG. 4. In part (B) of FIG. 12, the detection point of the first peak is depicted by a small circle. After that, performance dynamics corresponding to the first peak value is calculated through one of dynamics calculation processes I to V of step 78 of FIG. 3, and the calculated performance dynamics are output along with a key-on signal of key code "C3" corresponding to movement type "1".

Then, when the baton 20 is moved from the 240° position to a 0° position (horizontally to the right) in FIG. 11, a valley is detected by the operations of steps 80 to 85 of FIG. 5 at a direction change point in the swinging motion. As the baton 20 is moved to the 0° position (horizontally to the right), the second peak is detected as a peak of movement "2", and then performance dynamics corresponding to the second peak value is calculated, so that the calculated performance dynamics are output along with a tempo-key-on signal of key code "C#3".

Then, when the baton 20 is moved from the 0° position to a 120° position (obliquely to the upper left) in FIG. 11, a valley is detected at a direction change point in the swinging motion, and this time, the peak is detected as a peak of movement "3", and then performance dynamics corresponding to the third peak value is calculated, so that the calculated performance dynamics are output along with a tempo-key-on signal of key code "D3".

When the baton 20 is moved from the 120° position to the 240° position (obliquely to the lower left) in FIG. 11, a valley is detected at a direction change point in the swinging motion and the above-mentioned operations are repeated.

To the right of part (B) in FIG. 12 are shown peak detection points in the case where the baton 20 is moved vertically in duple or quadruple time. In this case, when the baton 20 is moved downwardly to a 270° position in FIG. 11, a first peak is detected as a peak of movement "1", and performance dynamics corresponding to the first peak value is calculated so that the calculated performance dynamics are output along with a tempo-key-on signal of key code "C3".

Then, when the baton 20 is moved from the 270° position upwardly to a 90° position in FIG. 11, a valley is detected at a direction change point in the swinging motion, and this time, a second peak is detected as a peak of movement "3". Thus, performance dynamics corresponding to the second peak value is calculated, so that the calculated performance dynamics are output along with a tempo-key-on signal of key code "D3".

When the baton 20 is then moved upwardly from the 90° position to the 270° position in FIG. 11, a valley is detected at a direction change point in the swinging motion and the above-mentioned operations are repeated.

In the above-mentioned manner, the baton 20, in response to a swinging motion by the human operator, can output tempo-key-on signals at such intervals as contemplated by the operator along with performance dynamics as contemplated by the operator. This allows performance tempo and dynamics to be controlled optionally by the electronic musical instrument 1H reproducing sequence data in response to the tempo key-on signals and performance dynamics.

Because the electronic musical instrument 1H is constructed to control a tempo of an automatic performance in such a manner that output timing of the tempo-key-on signals coincide with beat timing of the automatic performance, beat timing contemplated by the human operator will coincide with beat timing of an automatic performance.

Now, with reference to flowcharts of FIGS. 13 to 15, a description will be made below about exemplary operations by which the microcomputer (CPU 11) within the electronic musical instrument 1H reproduces tones in response to the tempo-key-on signals.

Figure 13:
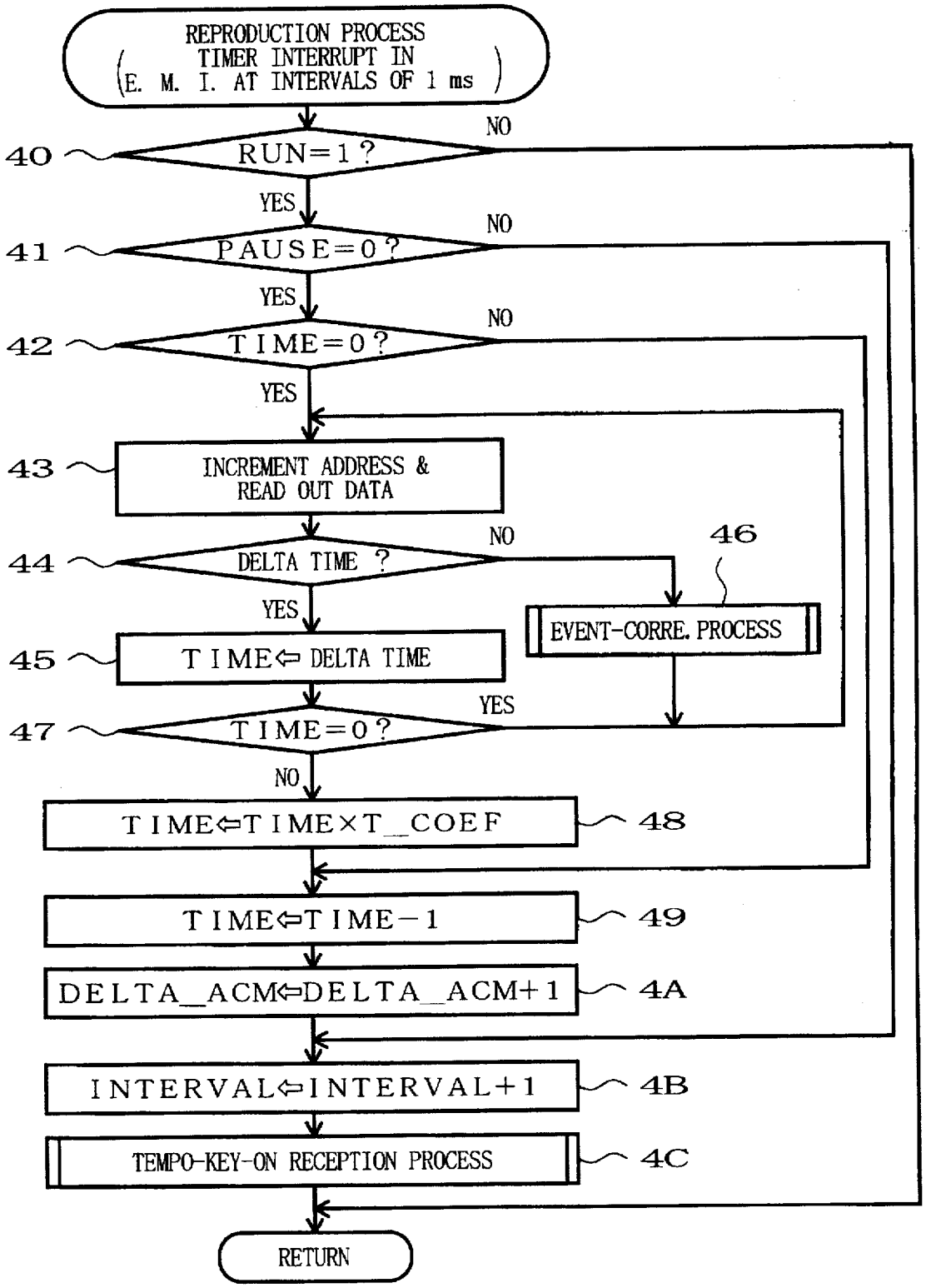
FIG. 13 is a flowchart illustrating an example of a tone reproduction process executed by a microcomputer within the electronic musical instrument of FIG. 1.

FIG. 13 illustrating an example of a tone reproduction process executed by the CPU 11 within the electronic musical instrument 1H. This reproduction process is a timer interrupt process performed in synchronism with operation clock pulses (generated at intervals of 1 ms) generated from the timer 19 and is carried out in the following step sequence.

Step 40: It is determined whether a running state flag RUN is at a value of "1" or not. If the flag RUN is at "1" (YES), it means that reproduction process is to be performed on automatic performance data, and thus the CPU 11 proceeds to next step 41, but if the flag RUN is at "0" (NO), it means that no reproduction process is to be performed, and thus the CPU 11 returns and waits until a next interrupt point.

Step 41: It is determined whether a pause flag PAUSE is at a value of "0" or not. If the flag PAUSE is at "0" (YES), it means that an automatic performance is at a pause as will be later described, and thus the CPU 11 proceeds to next step 42, but if the flag PAUSE is at "1" (NO), the CPU 11 jumps to step 4B.

Step 42: It is determined whether a timing counter TIME indicates a value of "0" or not. If the counter TIME indicates "0" (YES), it means that an automatic performance is at a pause as will be later described, and thus the CPU 11 proceeds to next step 43, but if the counter TIME indicates a value other than "0" (NO), the CPU 11 jumps to step 49.

Step 43: Now that the timing counter TIME indicates "0" as determined at step 42 or 47, the CPU 11 increments the read address of the RAM 12 to read out automatic performance data from the incremented address. Automatic performance data in this embodiment comprises combinations of event data (each including a channel number) and delta time data.

Step 44: A determination is made as to whether the data read out at the preceding step 43 is delta time. If so, the CPU 11 proceeds to next step 45, but if not, the CPU 11 branches to step 46.

Step 45: The data read out at step 43 is stored into the timing counter TIME.

Step 46: A process corresponding to the event data read out at step 43 (event correspondent process) is executed.

Figure 14:
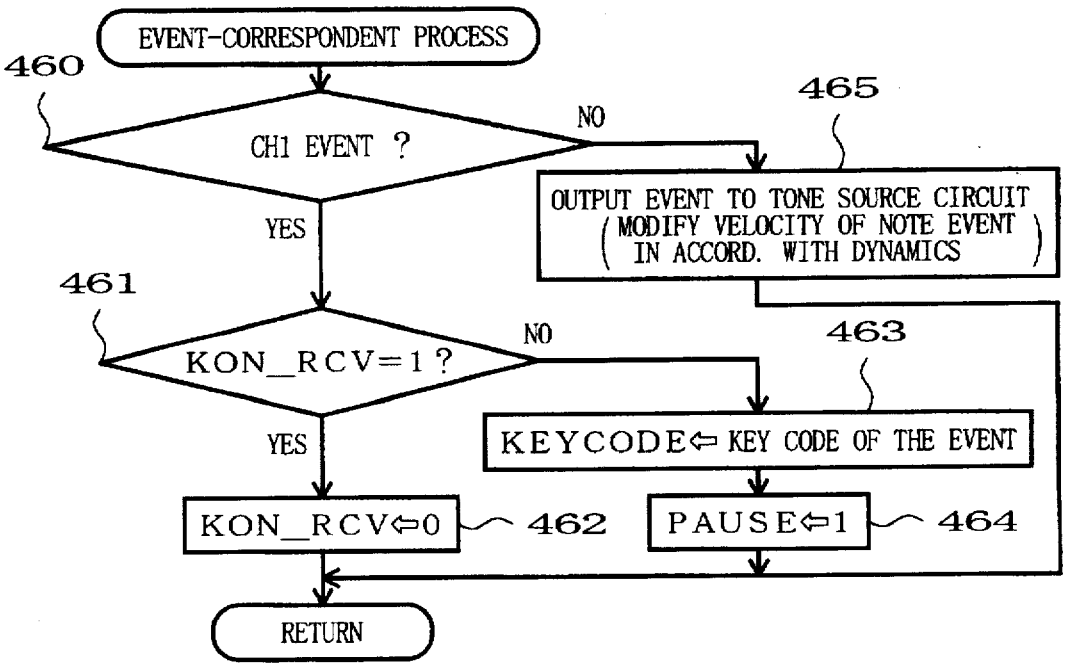
FIG. 14 is a flowchart illustrating a detail of an event-correspondent process of FIG. 13.

FIG. 14 illustrates a detail of the event-correspondent process, which is carried out in the following step sequence.

Step 460: Because in the embodiment the automatic performance data contain data of 16 channels CH1 to CH16 with channel number CH1 being used as a tempo control channel and a key-on event is used as a tempo control mark, this step determines whether the event data read out at step 43 represents an event of channel number CH1. If answered in the affirmative, the CPU 11 proceeds to step 461, but if not, the CPU 11 branches to step 465 because the event data concerns an event of another channel.

Key-on event of channel number CH1 is stored at the location of each beat timing, and key codes of individual events are stored in the order of C3, C#3, D3, C3, C#3, D3 . . . in the case of a triple-time music piece, and in the order of C3, D3, C3 and D# in the case of a duple-time or quadruple-time music piece.

Step 461: Now that the event data read out at step 43 represents an event of channel number CH1 as determined at step 460, a further determination is made here as to whether a key-on-receive flag KON_RCV is at a value of "1" or not. If the flag KON_RCV is at "1" (YES), the CPU 11 proceeds to next step 461, but if the flag KON_RCV is at "0" (NO), the CPU 11 branches to step 463.

Step 462: Because the affirmative determination at step 461 that the key-on-receive flag KON_RCV is at "1" means that a tempo-key-on signal has already been received from the baton 20 via the MIDI interfaces 27 and 1B before the event of channel number CH1 is read out, the flag KON_RCV is reset to "0" here, and then the CPU 11 goes to step 47 of FIG. 13.

Step 463: Because the determination at step 461 that the key-on-receive flag KON_RCV is at "0" means that a tempo-key-on signal corresponding to the event of channel number CH1 has not yet been received, the key code of the read-out event is stored into a key code register KEYCODE.

Step 464: Because the tempo-key-on signal corresponding to the event of channel number CH1 has not yet been received, the pause flag PAUSE is set to "1" and the CPU 11 goes to step 47 of FIG. 13. After the pause flag PAUSE is thus set to "1", the determination becomes negative at step 41 so that the operations of steps 42 to 4A of FIG. 13 are not performed.

Step 465: Now that the event data concerns an event of another channel number than channel number CH1 as determined at Step 460, the event data is supplied to the tone source circuit 17. At that time, if the event data is note event data, the velocity is modified in accordance with the performance dynamics calculated at step 78 of FIG. 3. By thus modifying the velocity, the tone volume can be controlled optionally in response to various operational characteristics of the baton 20 such as the swinging speed of the baton 20. Other factors than velocity, such as tone color, pitch and/or effect may be controlled as desired.

Step 47: Because the delta time read out at the preceding step 45 may sometimes be "0", a determination is made here again as to whether the timing counter TIME indicates a value of "0" or not. If the counter TIME indicates "0" (YES), the CPU 11 proceeds to next step 43, but if the counter TIME indicates a value other than "0" (NO), the CPU 11 jumps to step 49, similarly to step 42. If the delta time data is "0", it means that a plurality of events exist at the same timing.

Step 48: The stored value in the timing register TIME is multiplied by a value stored in a tempo coefficient register T_COEF (tempo coefficient). The tempo coefficient takes one of various values centering around "1", and the tempo is controlled by the value of this coefficient. For example, if the tempo coefficient is "0.5", the tempo doubles, but if the tempo coefficient is "2", the tempo is halved.

Step 49: The value stored in the timing register TIME is decremented by one.

Step 4A: Value stored in a delta accumulate register DELTA_ACM, which counts a time interval between events from channel number CH1, is decremented by one.

Step 4B: Value stored in an interval register INTERVAL, which counts a time interval between tempo-key-on signals sent from the baton 20, is decremented by one.

Step 4C: Tempo-key-on reception process is performed. This tempo-key-on reception process is triggered each time the tempo-key-on signal is received from the baton 20, and therefore, no substantial process is executed unless the tempo-key-on signal is received.

Figure 15:
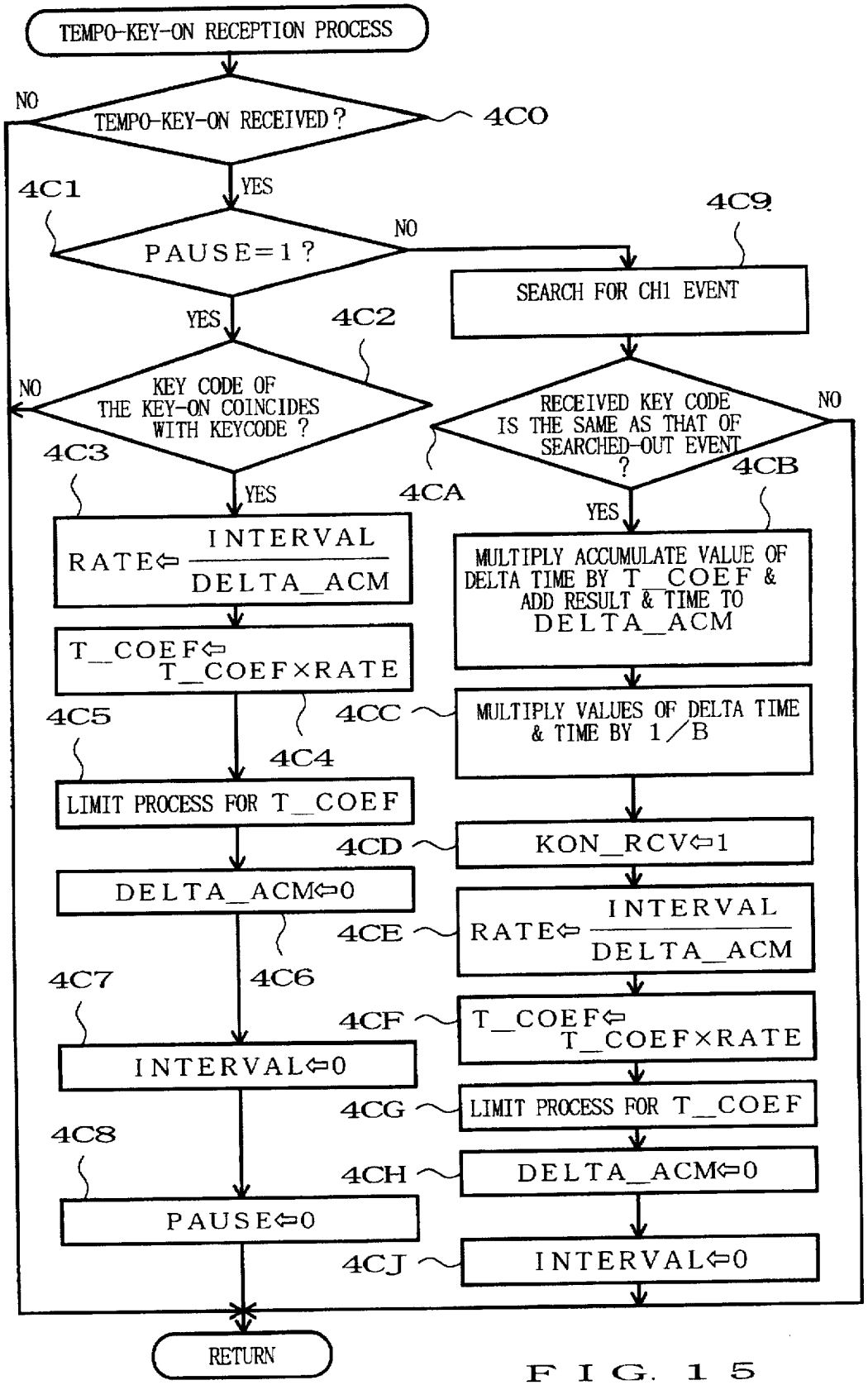
FIG. 15 is a flowchart illustrating a detail of a tempo-key-on reception process of FIG. 13.

FIG. 15 is a flowchart illustrating a detail of the tempo-key-on reception process, which is carried out in the following step sequence.

Step 4C0: It is checked whether a tempo-key-on signal has been received from the baton 20 via the MIDI interfaces 27 and 1B. If answered in the affirmative, the CPU 11 proceeds to step 4C1; otherwise, the CPU 11 returns to the reproduction process of FIG. 13 and waits until a next interrupt point.

Step 4C1: It is determined whether the pause flag PAUSE is at a value of "1" or not. If the flag PAUSE is at "1" (YES), the CPU 11 proceeds to next step 4C2, but if the flag PAUSE is at "0" (NO), the CPU 11 jumps to step 4C9.

Step 4C2: The determination at the preceding step 4C1 that the flag PAUSE is at "1" means that the event data of channel number CH1 has been read out prior to reception of the tempo-key-on signal and the key code of the event has already been stored in the key code register KEYCODE at step 463, and thus a further determination is made here as to whether the received tempo-key-on signal and the stored value in the key code register KEYCODE coincide with each other. If the received tempo-key-on signal and the stored value coincide (YES), the CPU 11 proceeds to step 4C3; otherwise, the CPU 11 returns to the reproduction process of FIG. 13 and waits until a next interrupt point.

Step 4C3: A ratio between stored values in the interval register INTERVAL and delta accumulate register DELTA_ACCUMULATE is stored into a rate register RATE; that is, a ratio between a time intervals between tempo-key-on signals sent from the baton 20 and a time interval between event data read out from channel number CH1 is stored into the rate register RATE.

Step 4C4: The stored value in the rate register RATE is multiplied by the value stored in the tempo coefficient register T_COEF.

Step 4C5: A limit process is performed in such a manner that the value in the tempo coefficient register T_COEF does not become greater or smaller than a predetermined value as a result of the operation of step 4C4.

Step 4C6: The delta accumulate registers DELTA_ACCUMULATE is set to a value of "0".

Step 4C7: The interval registers INTERVAL is set to a value of "0".

Step 4C8: The pause flag PAUSE is set to "0", so that the reproduction process of FIG. 13 is resumed.

Step 4C9: The determination at the preceding step 4C1 that the flag PAUSE is at "0" means that event data of channel number CH1 has not yet been read out, and thus the CPU 11 searches for and reads out a first event of channel CH1 appearing after this time point.

Step 4CA: It is determined whether the key code of the tempo-key-on signal is the same as that of the searched-out event of channel number CH1. If so, the CPU 11 proceeds to step 4CA, but if not, the CPU 11 returns to the reproduction process of FIG. 13 and waits until a next interrupt point.

Step 4CB: An accumulated value of delta time data of the individual events read out until the event of channel number CH1 is searched out at step 4C8 is multiplied by the tempo coefficient stored in the register T_COEF, and the value resultant from the multiplication and current stored value in the timing register TIME are added to the value stored in the accumulate register DELTA_ACM.

Step 4CC: The values of delta time data of the individual events read out and values stored in the timing register TIME until the searched-out event of channel number CH1 are multiplied by a value "1/B"; "B" is assumed in the embodiment to be a value not smaller than "1". Namely, the delta time values of the individual events and the corresponding stored values in the timing register TIME are reduced so that the reproduction speed is increased to allow the tempo-key-on signal reception timing and beat timing to get nearer each other.

Step 4CD: The key-on-receive flag KON_RCV is set to "1", and then the CPU 11 proceeds to step 4CE.

Steps 4CE to 4CJ will not be described here because they are the same as the above-described steps 4C3 to 4C7.

Now, with reference to FIGS. 16A and 16B, a description will be made below about exemplary operations by which the microcomputer (CPU 11) within the electronic musical instrument 1H reproduces tones in response to the tempo-key-on signals.

Figure 16A:
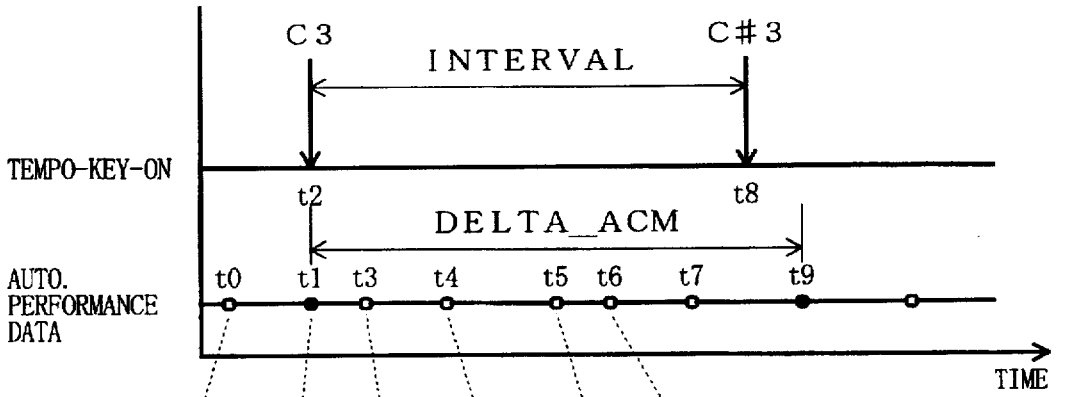
FIG. 16A is a timing chart illustrating relationships between input timing of tempo-key-on signals introduced from the baton into the electronic musical instrument and readout timing of automatic performance data.
Figure 16B:
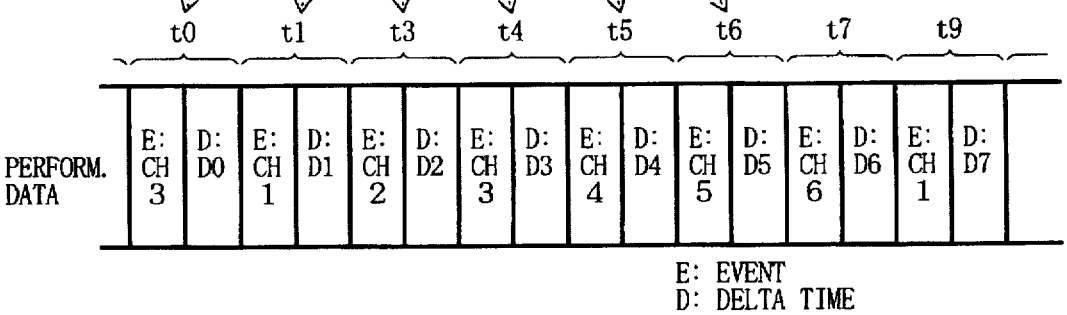
FIG. 16B is a diagram illustrating examples of performance data at time points t0 to t9 in FIG. 16A.

FIG. 16A is a timing chart illustrating relationships between input timing of tempo-key-on signals introduced from the baton 20 into the electronic musical instrument 1H and readout timing of automatic performance data, and FIG. 16B illustrates examples of performance data read out at time points t0 to t9 of FIG. 16A.

At time point t0, event data of channel number CH3 is read out at step 43 of FIG. 13 by way of steps 40 to 42 and then supplied to the tone source circuit at step 465 of FIG. 14. Delta time data D0 is read out at next step 43 and written into the timing register TIME at step 45.

After that, the timing register TIME reaches a value of "0" when the time indicated by the delta time data D0 has passed, and thus event data of channel number CH1 is read out at time point t1 by step 43 of FIG. 13 by way of steps 40 to 42. Because no tempo-key-on signal has not been received at time t1, a negative (NO) determination results, so that key code "C3" of the event is stored at step 463 of FIG. 14 into the key code register KEYCODE and the pause flag PAUSE is set to "1". Delta time data D1 is read out on next execution of step 43 and written into the timing register TIME at step 45.

Then, at time point t2 a little later than time point t1, a tempo-key-on signal and performance dynamics of key code "C3" are introduced from the baton 20 into the electronic musical instrument 1H. In response to this, the operations of steps 4C3 to 4C8 in the tempo-key-on reception process of FIG. 15 are performed by way of steps 4C0 to 4C2, so that a ratio, close to a value of "1", between stored values in the interval register INTERVAL and delta accumulate register DELTA_ACCUMULATE is newly stored into the rate register RATE, a tempo coefficient of virtually the same value as the last one is stored into the tempo coefficient register T_COEF and "0" is set into the interval register INTERVAL, delta accumulate register DELTA_ACM and pause flag PAUSE.

After that, the timing register TIME reaches a value of "0" when the time indicated by the delta time data D1 has passed, and thus event data of channel number CH2 is read out at time point t3 and supplied to the tone source circuit at step 465 of FIG. 14. At that time, the velocity of a note event is modified in accordance with the received performance dynamics. Delta time data D2 is read out on next execution of step 43 and written into the timing register TIME at step 45.

In the above-mentioned manner, event data and delta time data D3 to D6 of channel numbers CH3 to CH6 are sequentially read out at corresponding time points t3 to t7, and the read-out event data are supplied to the tone source circuit 17.

After that, at time point t8 within a period when the time indicated by delta time D6 is being counted (the timing register TIME is being decremented), a tempo-key-on signal and performance dynamics of key code "C#3" are introduced from the baton 20 into the electronic musical instrument 1H. In response to this, the operations of steps 4C9 to 4CJ in the tempo-key-on reception process of FIG. 15 are performed by way of steps 4C0 and 4C1.

Event data of key code "C#3" of channel number CH1 is searched out immediately at step 4CA, and thus the operation of step 4CB is executed by way of step 4CA. At step 4CB, the accumulated value of delta time is "0" because no delta time exits before the event data of channel number CH1 is searched out, and therefore only the stored value in the timing register TIME is added to the delta accumulate register DELTA_ACM. Thus, the value in the delta accumulate register DELTA_ACM is now greater than that in the interval register INTERVAL.

At step 4CC, in order to increase the reproduction speed at and after time point t8 when the tempo-key-on signal has been received, the delta time values of the individual events and the corresponding stored values in the timing register TIME are multiplied by 1/B. Then, the key-on receive flag KON_RCV is set to "1" at step 4CD, and at steps 4CE to 4CJ, a ratio, smaller than a value of "1", between the stored values in the interval register INTERVAL and delta accumulate register DELTA_ACCUMULATE is newly stored into the rate register RATE, a tempo coefficient of a smaller value than the last one is stored into the tempo coefficient register T_COEF, and "0" is set into the interval register INTERVAL and delta accumulate register DELTA_ACM.

After that, when the timing register TIME reaches a value of "0" and event data of channel number CH1 is read out at time point t9, "0" is set into the key-on receive flag KON_RCV at step 462 of FIG. 14. Thereafter, in the above-mentioned manner, event and delta time data of various channel numbers will be sequentially read out while being modified by a tempo coefficient smaller than "1" stored in the tempo coefficient register T_COEF, and the read-out event data will be supplied to the tone source circuit 17. That is, when the reception of the tempo-key-on signal from the baton 20 is earlier than the readout timing of the automatic performance data, the reproduction tempo of the automatic performance data is increased, but when the reception of the tempo-key-on signal from the baton 20 is later than the readout timing of the automatic performance data, the reproduction tempo of the automatic performance data is decreased.

Now, with reference to FIGS. 17 to 24, a description will be made hereinbelow about a tempo control function according to a second embodiment of the present invention. The same hardware structure of FIG. 1 may be employed to implement the second embodiment.

Figure 17:
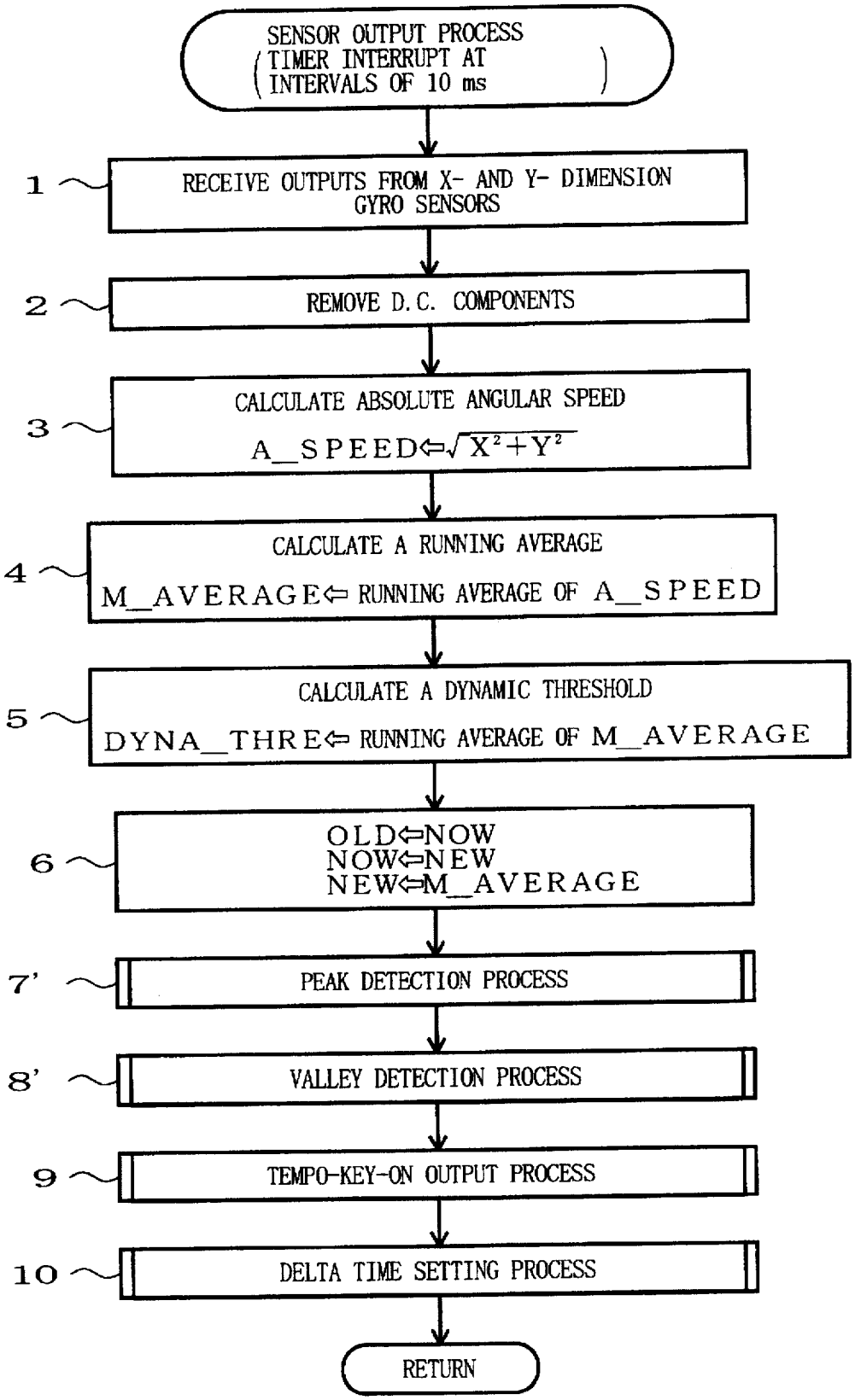
FIG. 17 is a flowchart illustrating an example of a sensor output process executed by the microcomputer within the baton of FIG. 1 to practice a second embodiment of the present invention.

Sensor output process performed in the second embodiment by the CPU 21 within the baton 20 is shown in FIG. 17, where steps 1 to 6 are the same as those of corresponding step numbers in FIG. 2. Peak detection process of step 7' shown in FIG. 17 is similar to the peak detection process of step 7 shown in FIG. 2 but partly different therefrom as shown in detail in FIGS. 18 and 19. Further, valley detection process of step 8' of FIG. 17 is similar to the valley detection process of step 7 of FIG. 2 but partly different therefrom as shown in detail in FIG. 20.

Figure 18:
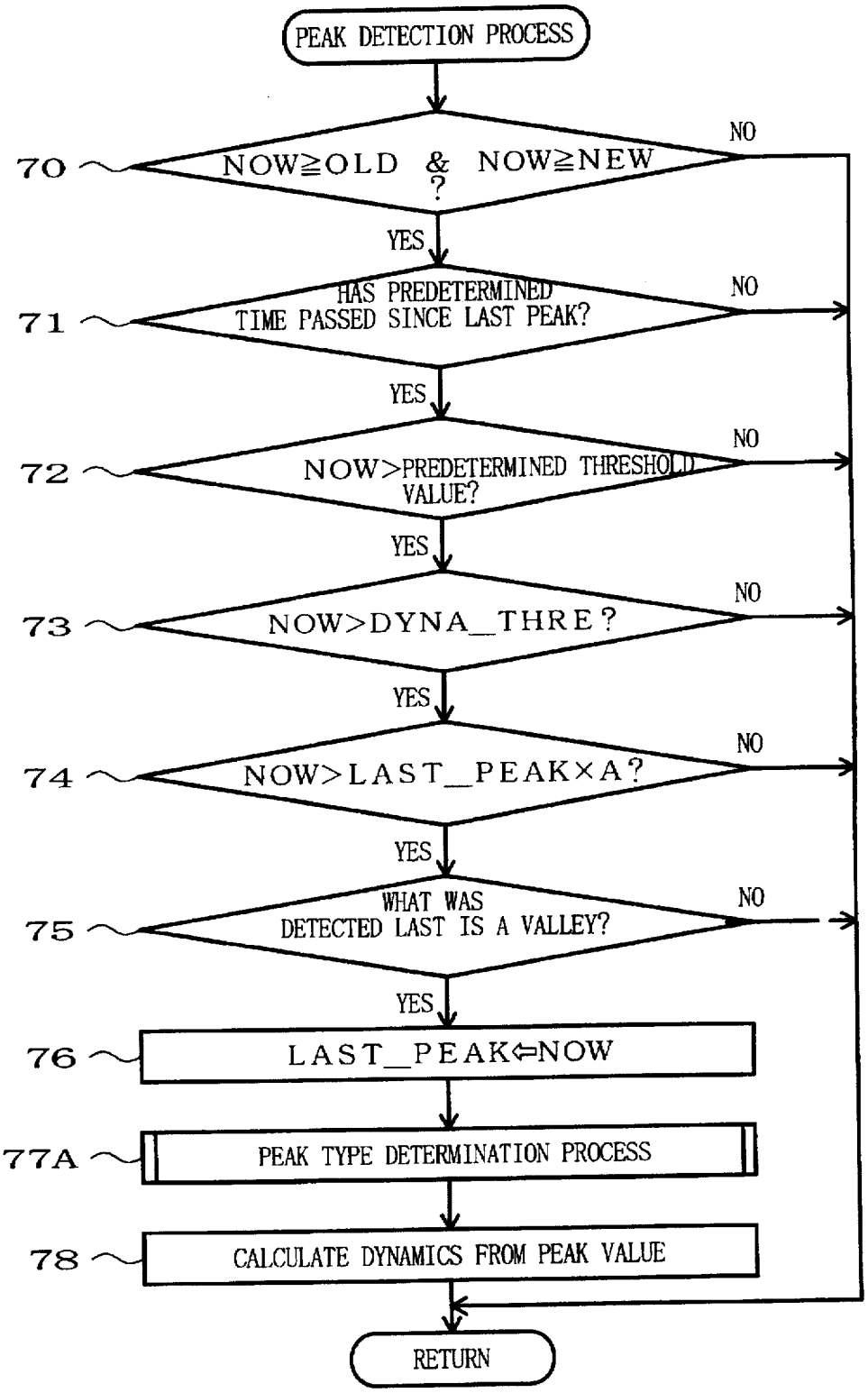
FIG. 18 is a flowchart illustrating a detail of a peak detection process of FIG. 17.

The sensor output process of FIG. 17 is different from the counterpart of FIG. 2 primarily in that steps 9 and 10 are added. The peak detection process of step 7' is flowcharted in detail in FIG. 18, where steps 70 to 76 and 78 are directed to the same operations of corresponding step numbers of FIG. 2. Peak type determination process of step 77A of FIG. 18 is flowcharted in detail in FIG. 19, where steps 770 to 775 are directed to the same operations of corresponding step numbers of FIG. 4 and steps 776 and 777 are added to the flow.

Step 776: A determination is made as to whether current stored value in a control mode register MODE is "1" or not. If it is "1" (YES), the CPU 21 of the baton 20 proceeds to step 777, but if it is "0" (NO), the CPU 78 goes to step 78 of FIG. 3. The control mode register MODE stores either of two values "1" and "0", "1" indicating that a tempo-key-on signal should be output at a peak detection point of absolute angular speed and "0" indicating that a tempo-key-on signal should be output at a valley detection point of absolute angular speed.

Step 777: Current stored value in the delay time register DLY_TIME is set into a delay time counter DELAY. The delay time counter DELAY is a counter for setting a predetermined time point at which a tempo-key-on signal is output after a peak or valley detection point.

Figure 19:
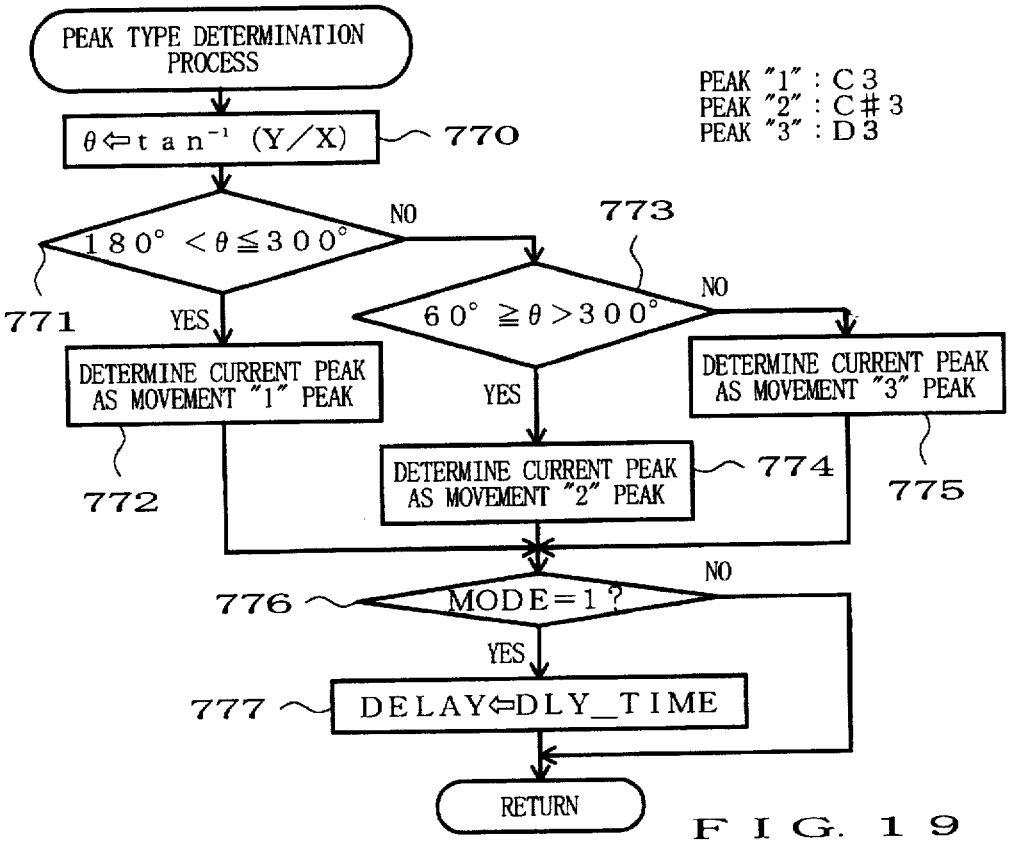
FIG. 19 is a flowchart illustrating a detail of a peak type detection process of FIG. 18.

Relationships between angles θ calculated by an arithmetic expression of step 770 of FIG. 19 and types of swinging movement are as shown in FIG. 11.

The valley detection process of step 8' is flowcharted in detail in FIG. 17, where steps 80 to 84 are directed to the same operations of corresponding step numbers of FIG. 5.

Figure 21:
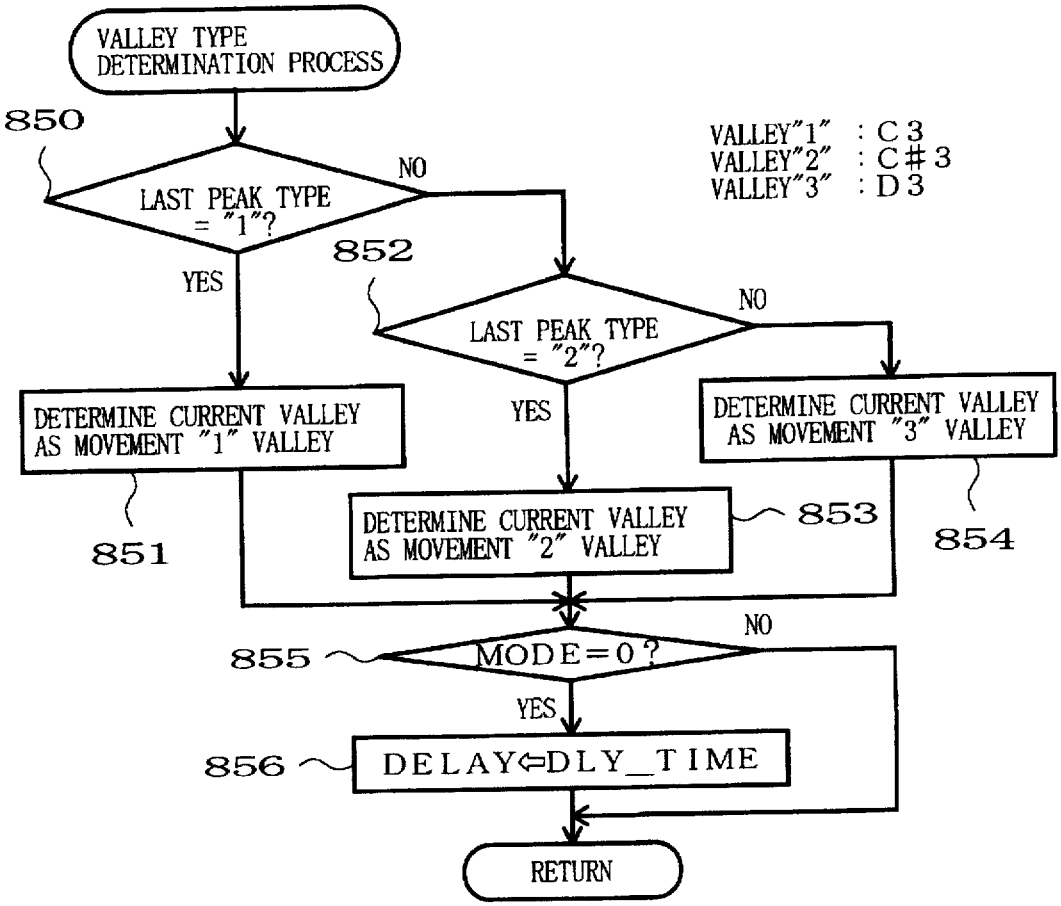
FIG. 21 is a flowchart illustrating a detail of a valley type determination process of FIG. 20.

At step 85A, a valley type determination process is executed, in accordance with a flow of FIG. 21, to check in what type of swinging condition a currently detected valley has occurred. In other words, this step determines after what type of peak has occurred the valley detected by steps 80 to 84.

FIG. 21 illustrates a detail of the valley type determination process, which is carried out in the following step sequence.

Step 850: A determination is made as to whether the peak type determined by the last execution of the peak type determination process is "1" or not. If it is "1" (YES), the CPU 21 proceeds to next step 851; otherwise, the CPU 21 branches to step 852.

Step 851: The current valley is determined as having occurred from movement type "1".

Step 852: A further determination is made as to whether the peak type determined by the last execution of the peak type determination process is "2" or not. If it is "2" (YES), the CPU 21 proceeds to next step 853; otherwise, the CPU 21 branches to step 854.

Step 853: The current valley is determined as having occurred from movement type "2".

Step 854: The negative determinations at steps 850 and 852 mean that the last peak type determined by the peak type determination process is "3", and thus the current valley is determined as having occurred from movement type "3".

Step 855: A determination is made as to whether the current stored value in a control mode-register MOD is "0" or not. If it is "0" (YES), the CPU 21 proceeds to next step 856, but if it is "1" (NO), the CPU 21 goes to step 9 of FIG. 17.

Step 856: Current stored value in the delay time register DLY_TIME is set into a delay time counter DELAY, and then the CPU 21 goes to step 9 of FIG. 17.

At step 9 of FIG. 17, a tempo-key-on output process is performed on the basis of the movement type determined by the peak type determination process of FIG. 19 or by the valley type determination process of FIG. 21.

Figure 22:
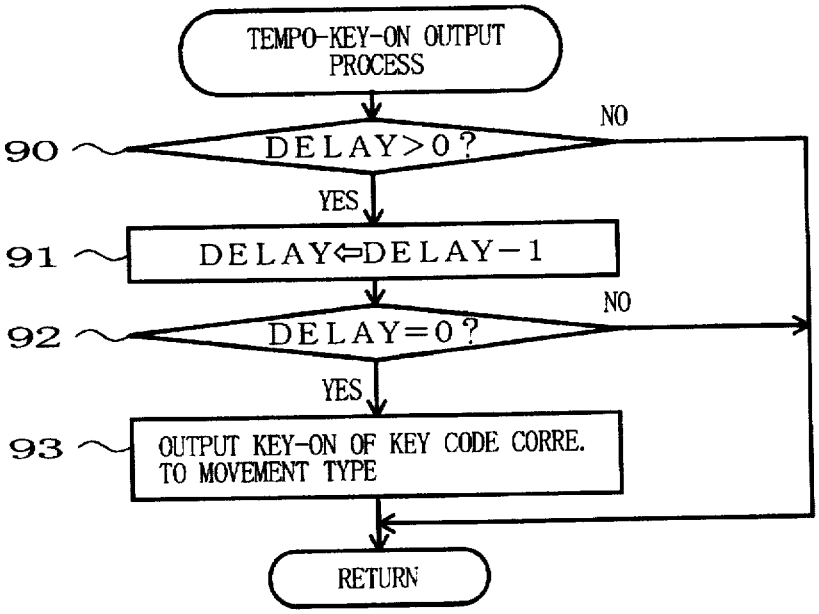
FIG. 22 is a flowchart illustrating a detail of a tempo-key-on output process of FIG. 17.

FIG. 22 illustrates a detail of the tempo-key-on output process, which is carried out in the following step sequence.

Step 90: A determination is made as to whether the current stored value in the delay counter DELAY is greater than "0". If so, the CPU 21 proceeds to next step 91; otherwise, the CPU 21 returns. Since the delay counter DELAY is normally set to "0" in an initialization process, the determination at this step becomes negative unless the value in the delay time register DLY_TIME is stored in the counter DELAY.

Step 91:The value in the delay counter DELAY is decremented by "1".

Step 92: A determination is made as to whether the current stored value in the delay counter DELAY is "0". If so, the CPU 21 proceeds to next step 93; otherwise, the CPU 21 returns.

Step 93: A key-on signal of a key code is output which corresponds to the movement type determined by the peak type determination process of FIG. 19 or by the type determination process of FIG. 21, and then the CPU 21 waits until a next timer interrupt point. In this embodiment, movement type "1" causes a key-on signal of key code "C3" to be output, movement type "2" causes a key-on signal of key code "C#3" to be output, and movement type "3" causes a key-on signal of key code "D3" to be output.

At step 10, a delay time setting process is performed in response to operation of one of the delay time switches provided on the baton 20.

Figure 23:
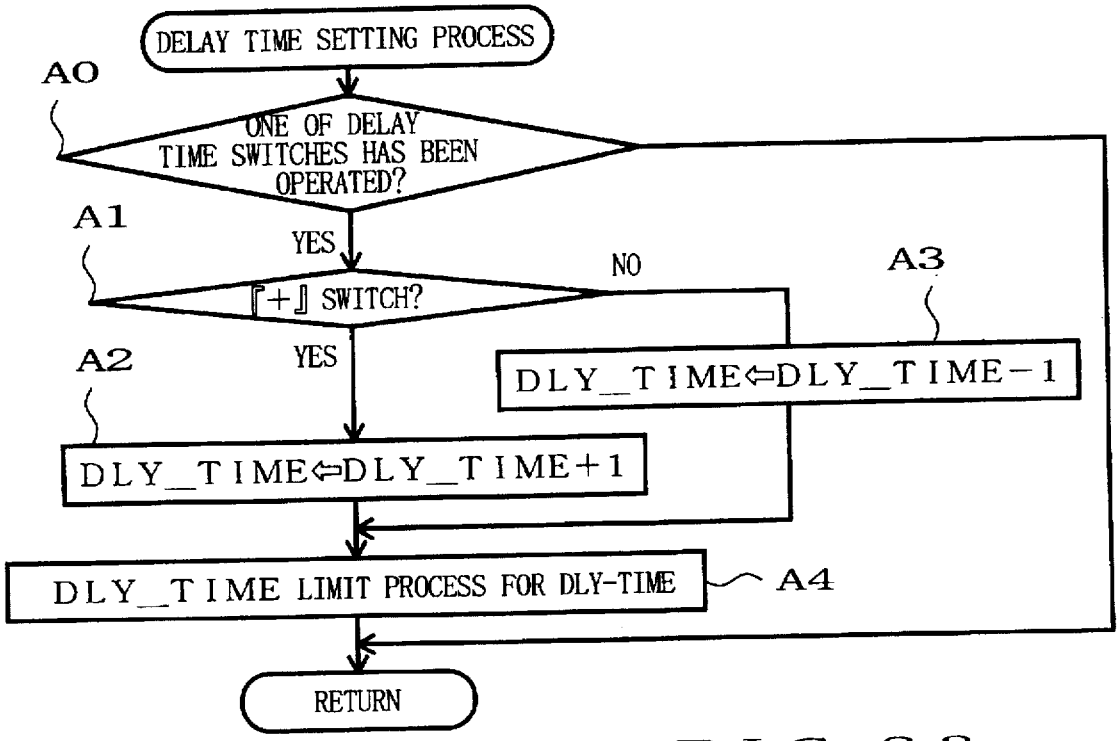
FIG. 23 is a flowchart illustrating a detail of a delay time setting process of FIG. 17.

FIG. 23 is a flowchart illustrating a detail of a delay time setting process of FIG. 17, which is carried out in the following step sequence.

Step A0: A determination is made as to whether one of the delay time switches has been operated on the baton 20. If so, the CPU 21 proceeds to next step A1; otherwise, the CPU 21 returns.

Step A1: Now that one of the delay time switches has been operated as determined at the preceding step A0, it is further determined whether the operated switch is a plus (+) delay time switch. If it is the plus delay time switch (YES), proceeds to step next A2; if it is a minus delay time switch (NO), the CPU 21 branches to step A3.

Step A2: Now that the plus delay time switch has been operated as determined at the preceding step A1, the delay time register DLY_TIME is incremented by "1".

Step A3: Now that the minus delay time switch has been operated as determined at the preceding step A1, the delay time register DLY_TIME is decremented by "1".

Step A4: A limit process is performed in such a manner that the value in the delay time register DLT_TIME does not become greater than a predetermined value or smaller than "1" as a result of the operation of step A2.

In this embodiment, value "1" in the delay time register DLY_TIME corresponds to 10 ms.

Figure 24:
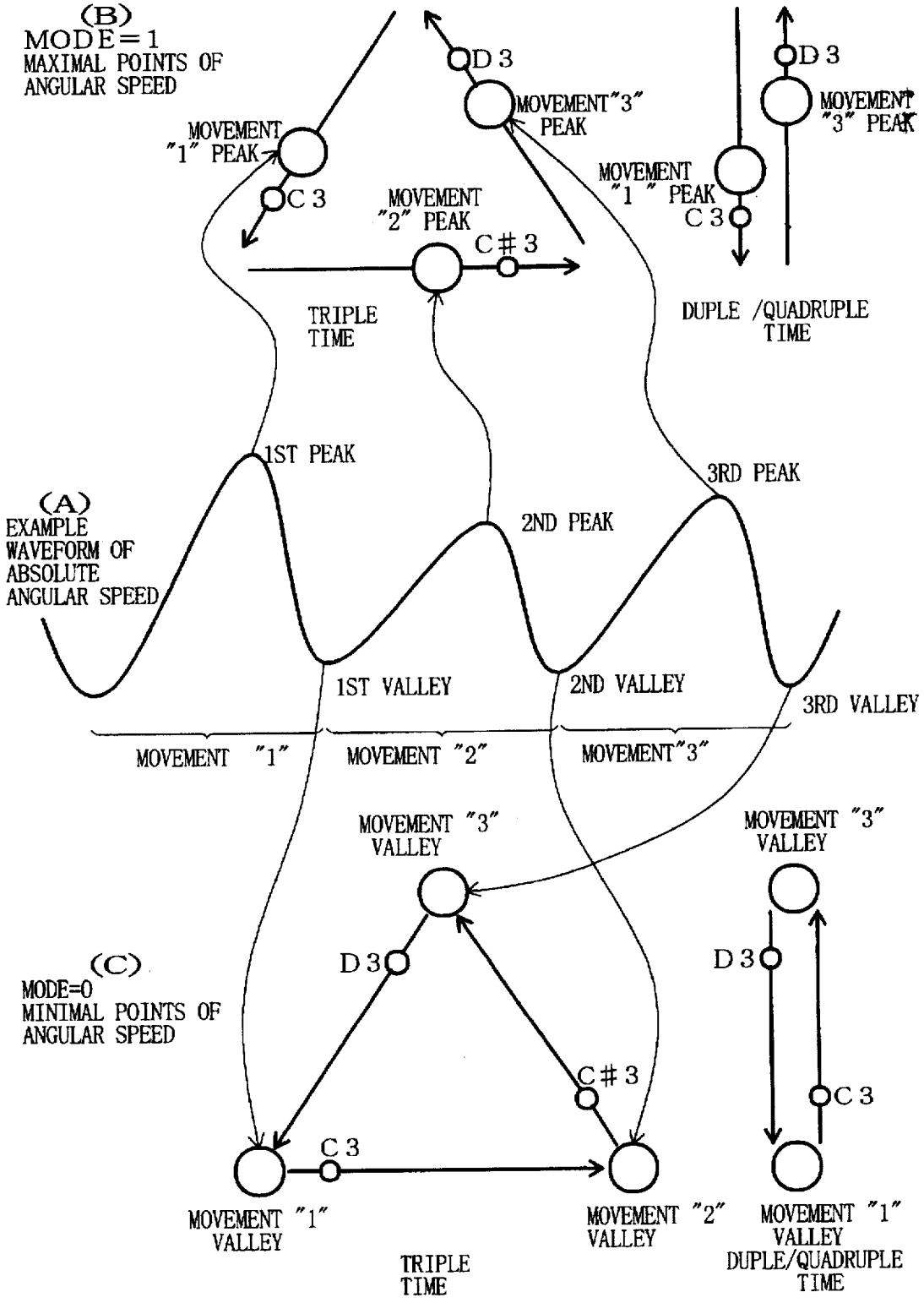
FIG. 24 is a conceptual diagram of the sensor output process when the baton is swung by the human operator in triple time in such a manner to draw a triangular locus.

Now, exemplary operation of the system will be described to explain how the sensor output process is performed in response to a swinging motion of the baton 20 effected by the human operator, with reference to FIG. 24. FIG. 24 is a conceptual diagram of the sensor output process when the baton 20 is moved by the operator in triple time in such a manner to draw a triangular locus.

Part (A) of FIG. 24 illustrates a waveform of absolute angular speed output as the baton 20 is moved in a triple-time locus, part (B) of FIG. 24 illustrates relationships between peak detection points and output timing of tempo-key-on signals in the case where a current stored value in the control mode register MODE is "1", and part (C) of FIG. 24 illustrates relationships between peak detection points and output timing of tempo-key-on signals in the case where a current stored value in the control mode register MODE is "0".

When the baton 20 is moved in a triangular locus as shown in parts (B) and (C) of FIG. 24, absolute angular speed values calculated at step 3 of FIG. 2 present a waveform as shown in part (A) of FIG. 24. As shown, peak and valley occur alternately in the order of a first peak, a first valley, a second peak, a second valley, a third peak and a third valley.

A description will first be made about the operation in the case where a current stored value in the control mode register MODE is "1". When the baton 20 is moved obliquely to a 240° position (to the lower left) in FIG. 11, the first peak is detected by the operations of steps 70 to 75 of FIG. 3, and the first peak is determined as a peak of movement "1" by the operation of step 771 of FIG. 19. Also, by the operation of step 777, the value in the delay time register DLY_TIME is stored in the counter DELAY. Thus, at a delayed time point when the delay counter DELAY reaches a value of "0" after the first peak detection, a tempo-key-on signal of key code "C3" is output by an operation of step 9. In part (B) of FIG. 24, the first peak detection point is depicted by a large circle, and the output time point of the tempo-key-on signal is depicted by a smaller circle.

Figure 20:
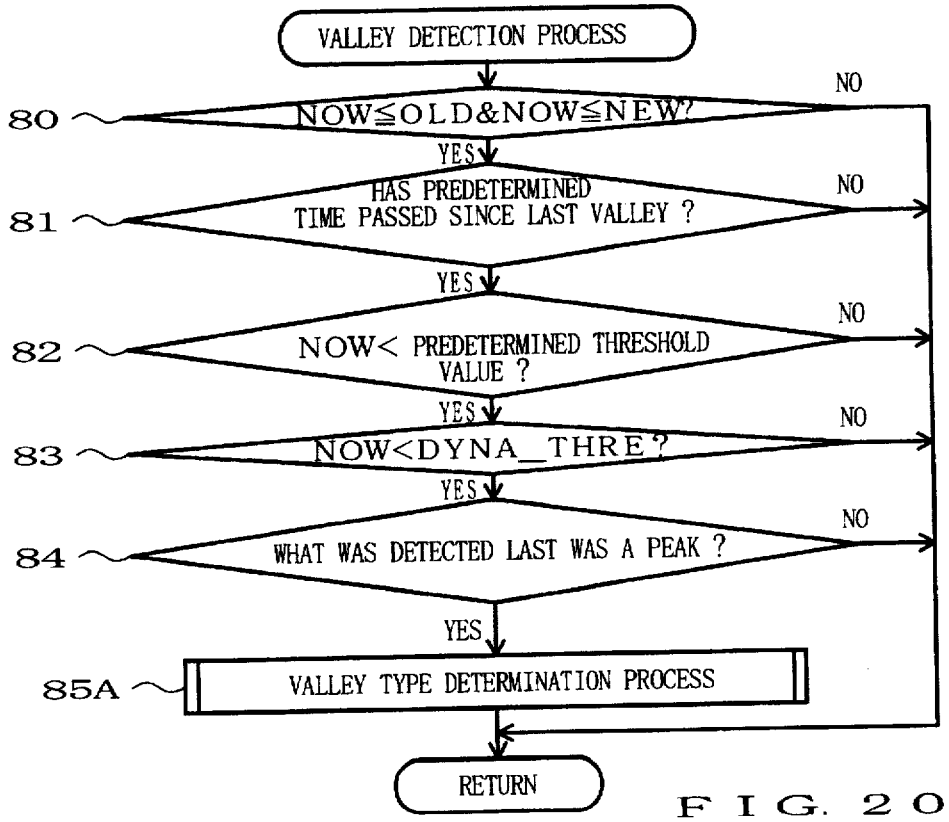
FIG. 20 is a flowchart illustrating a detail of a valley detection process of FIG. 17.

Then, when the baton 20 is moved from the 240° position to a 0° position (horizontally to the right) in FIG. 11, the first valley is detected by the operations of steps 80 to 84 of FIG. 20 at a direction change point in the swinging motion. The first valley is determined as a valley of movement "1" by the operation of step 850 of FIG. 21. Because the control mode register MODE currently stores "1", no value is stored into the delay counter DELAY, so that the process ends without outputting any tempo-key-on signal.

As the baton 20 is thus moved to the 0° position (horizontally to the right), the second peak is detected as a peak of movement "2", and a tempo-key-on signal of key code "C#3" is output at a time point that is a predetermined time after the second peak detection point.

Then, when the baton 20 is moved from the 0° position to a 120° position (obliquely to the upper left) in FIG. 11, the second valley is detected at a direction change point in the swinging motion, and the second valley is determined as a valley of movement "2".

As the baton 20 is thus moved to the 120° position, the third peak is detected as a peak of movement "3", and a tempo-key-on signal of key code "D3" is output at a time point that is a predetermined time after the third peak detection point.

Then, when the baton 20 is moved from the 120° position to the 240° position (obliquely to the lower left) in FIG. 11, the third valley is detected at a direction change point in the swinging motion as a valley of movement "3".

To the right of part (B) in FIG. 24 are shown relationships between peak detection points and output timing of tempo-key-on signals in the case where the baton 20 is moved vertically in duple or quadruple time. In this case, when the baton 20 is moved downwardly to a 270° position in FIG. 11, a first peak is detected as a peak of movement "1", and a tempo-key-on signal of key code "C3" is output at a time point that is a predetermined time after the first peak detection point.

Then, when the baton 20 is moved from the 270° position upwardly to the 90° position in FIG. 11, a first valley is detected as a valley of movement "1".

As the baton 20 is thus moved to the 90° position in FIG. 11, a second peak is detected as a peak of movement "3", and a tempo-key-on signal of key code "D3" is output at a time point that is a predetermined time after the second peak detection point.

Then, when the baton 20 is moved from the 90° position downwardly to the 270° position in FIG. 11, a second valley is detected as a valley of movement "3" at a direction change point in the swinging motion.

A description will be made next the operation in the case where a current stored value in the control mode register MODE is "0". In this case, when the baton 20 is moved obliquely to the 240° position (to the lower left) in FIG. 11, a first peak is detected by the operations of steps 70 to 75, and the first peak is determined as a peak of movement "1" by the operation of step 771 of FIG. 19. Because the control mode register MODE currently stores "0", no value is stored into the delay counter DELAY, so that the process ends without outputting any tempo-key-on signal.

Then, when the baton 20 is moved from the 240° position to the 0° position (horizontally to the right) in FIG. 11, a first valley is detected by the operations of steps 80 to 84 of FIG. 20 at a direction change point in the swinging motion. The first valley is determined as a valley of movement "1" by an operation of step 850 of FIG. 21. Also, by the operation of step 856, the value in the delay time register DLY_TIME is stored into the counter DELAY. Thus, at a delayed time point when the delay counter DELAY reaches a value of "0" after the first peak detection, a tempo-key-on signal of key code "C3" is output by the operation of step 9. In part (C) of FIG. 24, the first valley detection point is depicted by a large circle, and the output time point of the tempo-key-on signal is depicted by a smaller circle.

As the baton 20 is moved from the 240° position to the 0° position, a second peak is detected as a peak of movement Then, when the baton 20 is moved from the 0° position to the 120° position (obliquely to the upper left) in FIG. 11, a second valley is detected at a direction change point in the swinging motion as a valley of movement "2", so that a tempo-key-on signal of key code "C#3" is output at a time point that is a predetermined time after the second valley detection point.

As the baton 20 is thus moved from the 0° position to the 120° position, a third peak is detected as a peak of movement "3"

When the baton 20 is moved from the 120° position to the 240° position (obliquely to the lower left) in FIG. 11, a third valley is detected at a direction change point in the swinging motion as a valley of movement "3", so that a tempo-key-on signal of key code "D3" is output at a time point that is a predetermined time after the third valley detection point.

To the right of part (C) in FIG. 24 are shown relationships between peak detection points and output timing of tempo-key-on signals in the case where the baton 20 is moved vertically in duple or quadruple time. In this case, when the baton 20 is moved downwardly to the 27020 position in FIG. 11, a first peak is detected as a peak of movement "1". Then, when the baton 20 is moved from the 270° position upwardly to the 90° position in FIG. 11, a first valley is detected at a direction change point in the swinging motion as a valley of movement "1", so that a tempo-key-on signal of key code "C3" is output at a time point that is a predetermined time after the first peak detection point.

Also, as the baton 20 is thus moved from the 270° position upwardly to the 90° position in FIG. 11, a second peak is detected as a peak of movement "3".

Then, when the baton 20 is moved downwardly from the 90° position to the 270° position in FIG. 11, a second valley is detected at a direction change point in the swinging motion as a valley of movement "3", so that a tempo-key-on signal of key code "D3" is output at a time point that is a predetermined time after the third valley detection point.

As described above, by the human operator appropriately operating the delay time switches on the baton 20 and appropriately setting a delay time, the baton 20, in response to a swinging motion by the human operator, can output tempo-key-on signals at time points as contemplated by the operator. This allows performance tempo to be controlled optionally by the electronic musical instrument 1H reproducing sequence data in response to the tempo key-on signals.

Because the electronic musical instrument 1H is constructed to control a tempo of an automatic performance in such a manner that output timing of the tempo-key-on signals substantially coincides with beat timing of the automatic performance, beat timing contemplated by the human operator will coincide with beat timing of an automatic performance, in a similar manner to the first embodiment. The reproduction process as shown in FIGS. 13 to 16 in connection with the first embodiment may also be applied to the second embodiment.

While the preferred embodiments of the present invention have been described above as employing piezoelectric gyro sensors for sensing the operator's gesture or swinging motion, any other sensors may be employed, such as accelerometers or magnetic or optical sensors; for example, the gesture or swinging motion may be photographed to detect the individual stroke movements through known image processing. These different type sensors may be used in combination rather than singly.

Further, the preferred embodiments have been described above as extracting, as characteristics of the gesture or swinging motion, peaks and valleys of output signals from the piezoelectric gyro sensors, other factors may be extracted such as by changing the type of the sensors to be used.

Further, although the preferred embodiments have been described in connection with the baton 20 and electronic musical instrument 1H interconnected via MIDI interfaces, the baton 20 and electronic musical instrument 1H may of course be constructed integrally. Also, tempo clock pulses generated by the electronic musical instrument 1H may be supplied to an external device so as to control performance tempo of the external device.

Furthermore, although the preferred embodiments have been described in relation to the case where the baton 20 itself detects peaks and valleys, i.e., first and second characteristic points and further detects corresponding movement types, it should be obvious that the present invention may be constructed in such a manner that the baton 20 only provides sensor output values corresponding to the swinging motions executed by a human operator and the electronic musical instrument 1H performs necessary detections (peak and valley detection and movement type detection) in response to the sensor output values.

Furthermore, while the preferred embodiments have been described in relation to the case where two piezoelectric gyro sensors are used to detect the operator's gesture or swinging motion, three or more such piezoelectric gyro sensors may be used. In such a case, the sensors may be provided at different positions between triple time and ¾ time, and outputs from the three or more sensors may be evaluate together to detect the gesture or swinging motion.

Furthermore, while the preferred embodiments have been described in relation to the case where movement sensors are provided within the baton, such sensors may be attached directly to the body (e.g., hand) of a human operator or provided within a microphone or other equipment such as a remote control of a karaoke device. In such a case, the sensor output may be transmitted by wire or by wireless communication. Where the sensors are provided within a microphone, the present invention may be constructed in such a manner that tempo control is made effective only in the intro part of a karaoke music piece and performance tempo of the karaoke music piece is determined in response to swinging motions of the microphone by a singer.

Moreover, although the preferred embodiments have been described in relation to the case where the tempo control is constantly effected during an performance, performance tempo may be determined prior to a performance.

Further, while the preferred embodiments have been described in relation to the case where the performance data comprise data indicative of events and associated delta times, they may be stored in any other format; for example, the performance data may comprise data indicative of events and associated absolute times. The delta time data may be expressed in time units such as "ms" but also note length units such as 1/24 of a quarter note.

Further, while the preferred embodiments have been described in relation to the case where the tempo control is effected by multiplying a delta time value by a tempo coefficient to increase or decrease the delta time value, performance tempo may be changed by varying the processing intervals (timer interrupt timing).

Moreover, although the preferred embodiments have been described in relation to the case where tempo controlling data and automatic performance data are stored in mixture and identified by channel number, the tempo controlling data and automatic performance data are provided separately. As an example, data indicating memory addresses corresponding to note locations where tempo should be controlled may be used as tempo controlling data.

To effect a smooth tempo variation, a current value in the tempo coefficient register T_COEF may be interpolated with a preceding value. The performance dynamics control may also be varied smoothly.

In addition, although the present invention has been described in relation to the case where a detected peak value is multiplied by a predetermined value to calculate performance dynamics, the performance dynamics may be calculated by adding the detected peak value to a predetermined value. The predetermined value to be multiplied or added with the detected peak value may be varied on the basis of a variation in the peak level, or may be selected from among a plurality of values.

Where the dynamics are determined using a look-up table as in the dynamics calculation process I of FIG. 6, a plurality of such tables may be prepared so that one of the tables is selected depending on the detected peak level.

Moreover, although the present invention has been described in relation to the case where velocity is varied in accordance with the performance dynamics, tone color, pitch, effect etc. may be varied in accordance with the performance dynamics; alternatively, the number of performance parts may be increased or decreased. The performance performance dynamics may be controlled by controlling at least one of these factors.

Furthermore, while the dynamics calculation process III of FIG. 8 has been described as calculating a movement average of four peak values and setting the calculated average as performance dynamics, the movement average may of course be calculated of any other number of peak values.

Furthermore, while the dynamics calculation processes of FIGS. 9 and 10 have been described as calculating an average of current and last peak values and setting the calculated average as performance dynamics, an average of the current dynamics and performance dynamics for movements "1", "2" and "3" calculated at steps 782, 784 and 784 may be calculated and output as performance dynamics for the movement type.

Optimum control setting information (e.g., information indicating where control should be performed, i.e., which of peak and valley should be used for control and how long time delay should be) may be used for basic settings. The present invention may be constructed to vary the basic settings. Plural sets of such basic settings may be prepared so that one of the sets is selected as desired.

Furthermore, the present invention may be constructed to select only one of peak and valley (in which case delay time can not be set), or to only set delay time (in which case peak and valley can not be set). The delay time may be variably controlled in accordance with the tempo.

With the arrangements thus far described, the present invention can eliminate unevenness of performance dynamics caused by a human operator's habit in her or his hand-swinging motion and achieve performance dynamics contemplated by the operator. Further, the present invention can optionally control the tempo by, in response to an operator's hand-swinging motion, generating a tone at each time point contemplated by the operator and advancing read address of the sequence data.

What is claimed is:

1. A performance dynamics controlling apparatus comprising:

movement detection means for detecting a movement type and movement amount of a human operator's gesture on the basis of the gesture;

compensation means for compensating the movement amount in accordance with the movement type detected by said movement detection means; and control means for, on the basis of the movement amount compensated by said compensation means, controlling a predetermined factor to control dynamics of a performance.

2. A performance dynamics controlling apparatus as defined in claim 1 wherein said movement detection means detects a direction of the operator's gesture as the movement type.

3. A performance dynamics controlling apparatus as defined in claim 2 wherein as the direction of the operator's gesture, said movement detection means at least detects whether the gesture is either of downward and upward swinging movements or another movement.

4. A performance dynamics controlling apparatus as defined in claim 1 wherein as the movement amount, said movement detection means detects information relating to a speed or acceleration of the operator's gesture.

5. A performance dynamics controlling apparatus as defined bin claim 1 wherein said compensation means includes a table for compensating the movement amount in accordance with the detected movement type.

6. A performance dynamics controlling apparatus as defined in claim 1 wherein said compensation means includes operation means for compensating the movement amount by a predetermined arithmetic operation corresponding to the detected movement type.

7. A performance dynamics controlling apparatus as defined in claim 1 wherein the predetermined factor to be controlled by said control means is at least one of velocity, tone color, pitch and effect.

8. A performance dynamics controlling apparatus as defined in claim 1 which further comprises tempo control means for controlling a tempo of the performance on the basis of movement detection by said movement detection means.

9. A performance controlling apparatus comprising:

a movement responding device responsive to a human operator's gesture for generating output;

a detection device which, on the basis of the output of said movement responding device, outputs information indicative of a movement type and movement amount of the operator's gesture;

a control device which controls a value of the information indicative of the movement amount in accordance with the information indicative of the movement type outputted from said detection device; and a performance device which executes a tone generating performance on the basis of given performance information and controls the performance on the basis of the information indicative of the movement amount controlled by said control device.

10. A performance controlling apparatus as defined in claim 9 which further comprises a tempo control device that controls a tempo of the performance on the basis of the information outputted from said detection device.

11. A method for controlling dynamics of a performance on the basis of output generated by a movement detector in response to a human operator's gesture, comprising the steps of:

outputting information indicative of a movement type and movement amount of the operator's gesture on the basis of the output of said movement detector;

controlling a value of the information indicative of the movement amount in accordance with the information indicative of the movement type; and controlling dynamics of the performance on the basis of the information indicative of the movement amount controlled by said step of controlling.

12. A tempo controlling apparatus comprising:

movement detection means for detecting a human operator's gesture to output detected movement information;

extraction means for extracting first and second characteristic points, out of the operator's gesture detected by said movement detection means, which relate to a swinging movement of the operator; and control means for, whenever selected one of said first and second characteristic points is extracted by said extraction means, controlling a tempo of a performance on the basis of a time point at which said selected characteristic point has been extracted.

13. A tempo controlling apparatus as defined in claim 12 wherein said control means further controls the tempo of the performance on the basis of a time point that is a predetermined time after said extraction time point.

14. A tempo controlling apparatus as defined in claim 13 wherein said predetermined time can be variably set.

15. A tempo controlling apparatus as defined in claim 12 which further comprises mode selection means for optionally selecting either of said first and second characteristic points.

16. A tempo controlling apparatus as defined in claim 12 wherein as said first and second characteristic points, said extraction means extracts a peak and valley of the detected movement information.

17. A tempo controlling apparatus as defined in claim 16 wherein the detected movement information relates to a speed or acceleration of the operator's gesture.

18. A tempo controlling apparatus comprising:

movement detection means for detecting a human operator's gesture;

extraction means for extracting a characteristic point, out of the operator's gesture detected by said movement detection means, which relates to a swinging movement of the operator; and control means for, whenever the characteristic point is extracted by said extraction means, controlling a tempo of a performance on the basis of a time point that is a predetermined time after said time point at which said characteristic point has been extracted.

19. A tempo controlling apparatus as defined in claim 18 wherein said predetermined time can be variably set.

20. A tempo controlling apparatus as defined in claim 18 wherein said extraction means extracts an extreme value of output from said movement detection means.

21. A tempo controlling apparatus comprising:

a movement detector which detects a human operator's gesture;

an extraction device which, on the basis of output of said movement detector, selectively extracts at least one of minimal and maximal values indicative of repetitive gesture of the operator;

a selection device which selects one of the minimal and maximal values extracted or to be extracted by said extraction device; and a control device which controls a tempo of a performance on the basis of a time point at which the minimal or maximal value has been extracted by said extraction device in accordance with selection by said selection device.

22. A tempo controlling apparatus comprising:

a movement detector which detects a human operator's gesture;

an extraction device which, on the basis of output of said movement detector, time-serially extracts a plurality of extreme values indicative of repetitive gesture of the operator;

a setting device which sets a variable tempo controlling time point a predetermined time after a time point at which each said extreme value has been extracted; and a control device which controls a tempo of a performance on the basis of the tempo controlling time point set by said setting device.

23. A method for controlling a tempo of a performance on the basis of output generated by a movement detector in response to a human operator's gesture, comprising the steps of:

time-serially extracting minimal and maximal values indicative of repetitive gesture of the operator on the basis of output of said movement detector;

selecting one of the minimal and maximal values; and controlling a tempo of a performance on the basis of a time point at which the selected minimal or maximal value has been extracted.

24. A method for controlling a tempo of a performance on the basis of output generated by a movement detector in response to a human operators gesture, comprising the steps of:

time-serially extracting a plurality of extreme values indicative of repetitive gesture of the operator on the basis of output of said movement detector;

setting a tempo controlling time point a predetermined time after a time point at which each said extreme value has been extracted; and controlling a tempo of a performance on the basis of the tempo controlling time point.

* * * * *